US006450509B2

(12) United States Patent
Adams

(10) Patent No.: US 6,450,509 B2
(45) Date of Patent: Sep. 17, 2002

(54) HEELING APPARATUS AND METHOD

(75) Inventor: Roger R. Adams, The Colony, TX (US)

(73) Assignee: Heeling Sports Limited, Carrollton, TX (US)

( * ) Notice: Subject to any disclaimer, the term of this patent is extended or adjusted under 35 U.S.C. 154(b) by 0 days.

(21) Appl. No.: 09/540,125

(22) Filed: Mar. 31, 2000

Related U.S. Application Data

(60) Provisional application No. 60/127,459, filed on Apr. 1, 1999.

(51) Int. Cl.[7] ..... A63C 17/08
(52) U.S. Cl. ..... 280/11.24; 280/11.27
(58) Field of Search ..... 280/11.24, 11.226, 280/11.223, 11.27, 11.227, 843, 825

(56) References Cited

U.S. PATENT DOCUMENTS

| | | | | |
|---|---|---|---|---|
| 132,474 A | | 10/1872 | Lindley | |
| 202,191 A | | 4/1878 | Proctor | |
| 234,030 A | | 11/1880 | Hadley et al. | |
| 579,577 A | | 3/1897 | Hanscom | |
| 702,476 A | | 6/1902 | Price | |
| 875,560 A | | 12/1907 | Vaughan | |
| 881,079 A | | 3/1908 | Jolitz | |
| 892,152 A | | 6/1908 | Harman | |
| 966,821 A | | 8/1910 | Gaw | |
| 1,051,880 A | | 2/1913 | Glenn | |
| 1,056,091 A | | 3/1913 | Dickson | |
| 1,068,575 A | | 7/1913 | Demorey et al. | |
| 1,189,329 A | | 7/1916 | Winagle | |
| 1,260,901 A | | 3/1918 | Hayhurst | |
| 1,369,849 A | | 3/1921 | Spencer | |
| 1,428,232 A | | 9/1922 | Holmen | |
| 1,600,075 A | * | 5/1926 | Stoops | 280/11.24 |
| 1,592,692 A | | 7/1926 | Hackett | |
| 1,636,909 A | | 7/1927 | Haney | |
| 1,866,006 A | | 7/1932 | Bergstrand | |
| 1,975,661 A | | 10/1934 | Powell | 208/181 |
| 1,984,989 A | | 12/1934 | Reed | |
| 2,060,391 A | | 11/1936 | Castagnola | |
| 2,095,942 A | | 10/1937 | Wetterstrand | |
| 2,113,477 A | | 4/1938 | Gilman | |
| 2,114,461 A | | 4/1938 | Agosta et al. | |
| 2,114,790 A | | 4/1938 | Venables | 272/57 |
| 2,138,823 A | | 12/1938 | Werkman | |
| 2,165,581 A | | 7/1939 | Schroeder | |
| D117,918 S | | 12/1939 | Brodick | |
| D146,368 S | | 2/1947 | McCaffrey | |
| 2,422,228 A | | 6/1947 | Ferrar | 280/11.19 |
| 2,476,806 A | | 7/1949 | Brandt, Jr. | |
| 2,484,935 A | | 10/1949 | De Rooy | |

(List continued on next page.)

FOREIGN PATENT DOCUMENTS

| | | | | |
|---|---|---|---|---|
| AT | 309567 A | * | 10/1918 | 280/11.227 |
| CA | 1 138 194 | | 6/1980 | A43B/5/00 |

(List continued on next page.)

OTHER PUBLICATIONS

Advertisement for "Street Flyers" at the Internet website for FAO Schwartz, www.fao.com/faoschwarz/streetflyers.html dated Dec. 17, 1999.

Advertisement for "Sweet Flyers" at the Internet website for StreetFlyers,www.streetflyers.com/cgi–bin/ncommerce3/ExecMacro/home.d2w/report,dated Jan. 24, 2000.

*Primary Examiner*—Douglas Hess
*Assistant Examiner*—Elaine Gort
(74) *Attorney, Agent, or Firm*—Robert J. Ward

(57) ABSTRACT

A heeling apparatus includes a shoe with a unique feature in the heel that allows one to walk, run, or roll seamlessly. The appearance is that of normal footwear because of the covert wheel assembly. The stealth wheel in the heel gives one the ability to roll or slide in areas you could only walk. Heeling is a new activity that employs a unique method of rolling and requires a newly learned skill set of balance, positioning, and coordination.

19 Claims, 10 Drawing Sheets

U.S. PATENT DOCUMENTS

| | | | | | |
|---|---|---|---|---|---|
| 2,490,469 | A | | 12/1949 | Pittman | |
| D161,557 | S | | 1/1951 | Walker et al. | |
| 2,572,671 | A | | 10/1951 | Shaw | |
| 2,723,467 | A | | 11/1955 | Cassidy | |
| 2,897,609 | A | | 8/1959 | Bodkin | |
| 3,010,732 | A | | 11/1961 | Correll | |
| 3,027,661 | A | | 4/1962 | McCord | |
| 3,032,894 | A | | 5/1962 | Kennedy et al. | |
| 3,112,119 | A | | 11/1963 | Sweet | 280/11.2 |
| 3,176,416 | A | | 4/1965 | Seegert | |
| 3,306,623 | A | | 2/1967 | Weitzner | 280/11.12 |
| 3,351,353 | A | | 11/1967 | Weitzner | 280/7.13 |
| 3,374,002 | A | | 3/1968 | Lewis | |
| 3,478,447 | A | | 11/1969 | Gillead | |
| 3,486,250 | A | | 12/1969 | Purtle | |
| 3,789,523 | A | | 2/1974 | Rubin | 36/2.5 |
| D231,999 | S | * | 7/1974 | Engman | 280/11.24 |
| D233,619 | S | | 11/1974 | Kelling | |
| 3,876,217 | A | | 4/1975 | Copier | 280/11.23 |
| 3,884,485 | A | | 5/1975 | Wälle | 280/11.1 R |
| 3,934,359 | A | | 1/1976 | Fletcher | 36/73 |
| 3,963,251 | A | * | 6/1976 | Miano | 280/843 |
| 3,983,643 | A | * | 10/1976 | Schreyer et al. | 280/11.19 |
| 3,997,179 | A | | 12/1976 | de Blois | |
| 4,088,334 | A | | 5/1978 | Johnson | 280/11.2 |
| 4,095,817 | A | | 6/1978 | Cohen | 280/87.04 |
| D250,492 | S | | 12/1978 | Kish | D34/15 AJ |
| 4,133,548 | A | | 1/1979 | Smith | 280/87.04 |
| 4,138,127 | A | | 2/1979 | Kimmell et al. | 280/11.23 |
| 4,149,735 | A | | 4/1979 | Blackburn et al. | 280/87.04 |
| 4,150,497 | A | | 4/1979 | Weber | 35/11 R |
| 4,183,547 | A | | 1/1980 | Cohen et al. | 280/87.04 |
| 4,245,406 | A | | 1/1981 | Landay et al. | 36/14 |
| 4,295,655 | A | | 10/1981 | Landay et al. | 280/11.2 |
| 4,303,253 | A | | 12/1981 | Rottenkolber | 280/11.27 |
| 4,316,334 | A | | 2/1982 | Hunt | 36/91 |
| 4,364,187 | A | | 12/1982 | Melendez | 36/15 |
| 4,417,737 | A | | 11/1983 | Suroff | 280/11.115 |
| 4,496,025 | A | | 1/1985 | Gattman | 182/121 |
| 4,523,767 | A | | 6/1985 | Le Page | 280/11.19 |
| 4,638,575 | A | | 1/1987 | Illlustrato | 36/38 |
| 4,676,010 | A | | 6/1987 | Cheskin | 36/32 R |
| 4,691,453 | A | | 9/1987 | Tifre | 36/8.3 |
| 4,763,909 | A | | 8/1988 | Bergeron | 280/11.25 |
| 4,783,910 | A | | 11/1988 | Boys, II et al. | 36/107 |
| 4,795,181 | A | | 1/1989 | Armstrong | 280/87.04 |
| 4,817,974 | A | | 4/1989 | Bergeron | 280/11.2 |
| 4,841,648 | A | | 6/1989 | Shaffer et al. | 36/43 |
| 4,843,741 | A | | 7/1989 | Yung-Mao | 36/114 |
| D302,994 | S | | 8/1989 | Hawkes et al. | D21/227 |
| 4,887,824 | A | | 12/1989 | Zatlin | 280/87.04 |
| 4,897,939 | A | | 2/1990 | Harrington | 36/108 |
| 4,928,982 | A | | 5/1990 | Logan | 280/11.22 |
| 4,947,560 | A | | 8/1990 | Fuerst et al. | 36/88 |
| 4,977,691 | A | | 12/1990 | Orchard | 36/44 |
| 4,988,122 | A | | 1/1991 | Saunders | 280/841 |
| 5,056,240 | A | | 10/1991 | Sherrill | 36/7.3 |
| 5,134,791 | A | | 8/1992 | Gregory | 36/107 |
| 5,249,376 | A | | 10/1993 | Capria | 36/115 |
| 5,286,043 | A | | 2/1994 | Tkaczyk | 280/11.22 |
| 5,319,866 | A | | 6/1994 | Foley et al. | 36/91 |
| 5,319,869 | A | | 6/1994 | McDonald et al. | 36/114 |
| D352,818 | S | | 11/1994 | Bailey | D2/919 |
| 5,384,973 | A | | 1/1995 | Lyden | 36/25 |
| 5,388,350 | A | | 2/1995 | Parker, Jr. | 36/115 |
| 5,392,537 | A | | 2/1995 | Goldberg | 36/134 |
| 5,393,077 | A | | 2/1995 | Wanous | 280/7.13 |
| 5,396,675 | A | | 3/1995 | Vincent et al. | 12/142 |
| 5,398,970 | A | | 3/1995 | Tucky | 280/841 |
| 5,410,821 | A | | 5/1995 | Hilgendorf | 36/100 |
| 5,417,444 | A | | 5/1995 | Chen | 280/87.042 |
| 5,425,186 | A | | 6/1995 | Hoyt | 36/97 |
| 5,511,824 | A | | 4/1996 | Kim | 280/841 |
| 5,527,050 | A | * | 6/1996 | Szendel | 280/11.27 |
| D373,674 | S | | 9/1996 | Dolinsky | D2/956 |
| 5,572,804 | A | | 11/1996 | Skaja et al. | 36/29 |
| 5,595,004 | A | | 1/1997 | Lyden et al. | 36/39 |
| 5,632,104 | A | | 5/1997 | Zohar | 36/88 |
| 5,638,614 | A | | 6/1997 | Hardy | 36/113 |
| 5,655,316 | A | | 8/1997 | Huang | 36/132 |
| 5,682,685 | A | | 11/1997 | Terlizzi | 36/8.3 |
| 5,697,643 | A | | 12/1997 | Marasco et al. | 280/825 |
| 5,716,074 | A | | 2/1998 | Theodorou | 280/843 |
| 5,716,723 | A | | 2/1998 | Van Cleef et al. | 428/690 |
| 5,730,467 | A | | 3/1998 | Huang | 280/843 |
| 5,785,327 | A | * | 7/1998 | Gallant | 280/11.27 |
| 5,797,609 | A | | 8/1998 | Fichepain | 280/11.19 |
| 5,823,913 | A | | 10/1998 | Aruin | 482/4 |
| 5,836,591 | A | | 11/1998 | Roderick et al. | 280/11.22 |
| 5,839,737 | A | | 11/1998 | Kruczek | 280/11.115 |
| D401,739 | S | | 12/1998 | James | D2/946 |
| D404,550 | S | | 1/1999 | James | D2/960 |
| 5,881,413 | A | | 3/1999 | Throneburg | 12/133 |
| 5,882,018 | A | | 3/1999 | Petrosino | 280/7.13 |
| 5,885,500 | A | | 3/1999 | Tawney et al. | 264/154 |
| 5,887,898 | A | | 3/1999 | Petrosino | 280/825 |
| D408,123 | S | | 4/1999 | James | D2/969 |
| 5,927,729 | A | | 7/1999 | De Fillippo | 280/11.3 |
| 5,927,737 | A | | 7/1999 | Horton, II et al. | 280/87.042 |
| D412,778 | S | | 8/1999 | James | D2/951 |
| D412,779 | S | | 8/1999 | James | D2/957 |
| D413,193 | S | | 8/1999 | James | D2/947 |
| 5,951,049 | A | * | 9/1999 | Calverley et al. | 280/825 |
| 5,967,552 | A | | 10/1999 | Roderick et al. | 280/843 |
| 5,970,631 | A | | 10/1999 | Inman | 36/115 |
| 5,997,105 | A | * | 12/1999 | Wu | 280/DIG. 6 |
| 6,006,450 | A | | 12/1999 | Hayes | 36/107 |
| 6,006,451 | A | | 12/1999 | Morris et al. | 36/115 |
| 6,041,525 | A | | 3/2000 | Kelley | 36/115 |
| 6,050,357 | A | | 4/2000 | Staelin et al. | 180/65.1 |
| 6,061,930 | A | | 5/2000 | Zinovieff | 36/115 |
| 6,070,887 | A | * | 6/2000 | Cornelius et al. | 280/11.27 |
| 6,092,305 | A | | 7/2000 | Troy et al. | 36/3 |
| 6,115,946 | A | | 9/2000 | Morris et al. | 36/115 |
| 6,120,039 | A | * | 9/2000 | Clementi | 280/11.27 |
| D433,214 | S | | 11/2000 | McDowell | D2/957 |
| 6,151,806 | A | | 11/2000 | Morris et al. | 36/136 |
| 6,158,150 | A | | 12/2000 | Morris et al. | 36/115 |
| 6,195,918 | B1 | | 3/2001 | Kelley et al. | 36/115 |
| 6,195,920 | B1 | | 3/2001 | Morris et al. | 36/132 |
| 6,226,900 | B1 | | 5/2001 | Mazars | 36/132 |
| 6,243,972 | B1 | | 6/2001 | De France | 36/117.1 |
| 6,247,251 | B1 | | 6/2001 | James | 36/115 |
| 6,247,708 | B1 | | 6/2001 | Hsu | |
| 6,250,656 | B1 | | 6/2001 | Ibara | 280/87.04 |
| 6,308,964 | B1 | | 10/2001 | Chang | |

FOREIGN PATENT DOCUMENTS

| | | | |
|---|---|---|---|
| CA | 1 239 017 | 3/1983 | A43B/5/00 |
| CA | 2258978 | 7/1999 | A63C/17/20 |

| | | | | | |
|---|---|---|---|---|---|
| CA | 2258980 | | | 7/1999 | ..... A63C/17/20 |
| DE | 254775 | | | 5/1912 | |
| DE | 456796 | | * | 3/1928 | ..... 280/843 |
| DE | 821323 | | | 7/1949 | |
| DE | 197 55 340 | A1 | | 6/1999 | ..... A63C/17/20 |
| FR | 1194886 | A | | 4/1958 | |
| FR | 2196826 | | | 3/1974 | ..... A63C/17/20 |
| GB | 2297 | | * | 8/1877 | ..... 280/11.24 |
| GB | 117176 | | | 9/1917 | |
| GB | 150512 | A | | 8/1919 | |
| GB | 216903 | A | | 6/1924 | |
| GB | 296 13 508 | U1 | | 3/1996 | ..... A63C/17/00 |
| KR | 90-11303 | | | 3/1988 | |
| WO | PCT/US97/11652 | | | 7/1997 | ..... A43B/23/00 |
| WO | WO 98/01051 | | | 1/1998 | |

* cited by examiner

HEELING APPARATUS AND METHOD

CROSS-REFERENCE TO RELATED APPLICATIONS

Pursuant to 35 U.S.C. § 119(e), this application claims the benefit of U.S. Provisional Patent Application No. 60/127,459, entitled *Heeling Apparatus and Method*, filed Apr. 1, 1999, and named Roger R. Adams as inventor, which is hereby incorporated by reference for all purposes.

TECHNICAL FIELD OF THE INVENTION

This invention relates in general to the field of footwear and active sports and more particularly to a heeling apparatus and method.

BACKGROUND OF THE INVENTION

Action or extreme sports include various sports such as, for example, skateboarding, snow boarding, in-line skating, rock climbing, and skydiving. Most action or extreme sports require expensive and cumbersome equipment that can only be used in select and, often, limited areas. Because these select and limited areas are not convenient to most people, these activities can only be enjoyed at select times. This results in a substantial investment in equipment that is only used sporadically, when large blocks of time are available to travel to such select and limited areas available for the activity. Because of these limitations and inconveniences, many times interest in the activity wanes.

SUMMARY OF THE INVENTION

The present invention presents the rare opportunity to create an entirely new sport and activity with mass appeal that does not suffer from the disadvantages, limitations, and problems mentioned above. From the foregoing it may be appreciated that a need has arisen for a heeling apparatus and related methods to create the foundation for a new action or extreme sport that can be pursued in many locations and conditions without the need for a large investment in equipment.

According to one aspect of the present invention, a heeling apparatus is provided that includes a footwear having an opening in a sole, such as the heel portion of the sole, to receive a wheel assembly, and a wheel assembly positioned in the opening of the sole of the footwear. The wheel assembly may include an axle, a wheel mounted on the axle, and a mounting structure operable to support the axle. In alternative embodiments, the wheel assembly includes only the wheel mounted on the axle without the need for the mounting structure. In other embodiments, the mounting structure is integrated or included as part of the opening in the sole of the footwear.

According to another aspect of the present invention a wheel/axle assembly for use in a wheel assembly of a heeling apparatus is provided that includes a wheel, a first bearing, a second bearing, and an axle. The wheel has an axle opening, a first annular recess on a first side of the wheel that surrounds the axle opening on the first side, and a second annular recess on a second side of the wheel that surrounds the axle opening on the second side. The first bearing is positioned in the first annular recess on the first side of the wheel, and the second bearing is positioned in the second annular recess on the second side of the wheel. The axle is positioned within the axle opening of the wheel such that the wheel is rotatably coupled to the axle through the first bearing and the second bearing.

According to yet another aspect of the present invention, a method for using a heeling apparatus on a surface is provided that includes running on a surface by using a forefoot portion of a sole of the heeling apparatus to contact the surface, and rolling on the surface with a wheel of the heeling apparatus extended below the bottom of the sole through an opening in the sole by using a wheel of the heeling apparatus to contact the surface.

According to a still further aspect of the present invention, a method for making a heeling apparatus is provided that includes providing a footwear that includes a sole, forming an opening in the sole of the footwear that extends to a bottom surface of the sole, and positioning a wheel assembly in the opening of the sole of the footwear.

The present invention provides a profusion of technical advantages that include the capability of the heeling apparatus to function as normal, comfortable footwear for walking, and even running, and to function as rolling footwear, which may be referred to only herein as "heeling."

Another technical advantage of the present invention includes the capability to implement the invention using virtually any available footwear such as, for example, conventional shoes, boots, dress shoes, loafers, sandals, slippers, bindings, and the like. Conventional footwear may be incorporated into a heeling apparatus by, preferably, forming or cutting an opening in the heel portion of the sole of such conventional footwear. Thus, the present invention may be implemented using conventional footwear that appears externally, during normal use, as conventional footwear. This allows the present invention to be practiced as a "stealth" or "covert" activity because, from external appearances, it is being performed using conventional footwear. In a preferred embodiment of the present invention, the sole of conventional athletic shoes may be used in the present invention without the need to design awkward looking thick soled shoes to house the wheel.

A further technical advantage of the present invention includes the capability to implement the present invention with other active sport accessories such as in a grind show, such as the grind show made by SOAP, which also provides grinding or sliding functionality.

Yet another technical advantage includes the capability to use the present invention to enjoyably obtain an overall aerobic workout.

Still yet another technical advantage of the present invention includes the capability of enhanced control for turning and maneuvering, while still providing durability, reliability, and mechanical strength. The present invention provides this durability and reliability in harsh environments and with heavy and demanding use, including the capability to withstand the forces of jumps, spins and maneuvers of all kinds.

Another technical advantage includes capability of removable wheels and axles so that bearings may be easily changed and maintained and so that different types of wheels, bearings, and axles may be used as desired by the user and as dictated by the conditions.

In yet a further technical advantage of the present invention includes a wheel/axle assembly that can be easily inserted or removed from a wheel assembly or mounting structure, such as by using a friction fit. In other embodiments, the wheel assembly, or heeling apparatus, includes the capability of a retractable wheel. This allows a user to quickly and conveniently convert from using the heeling apparatus as normal footwear into using the heeling apparatus for "heeling." The wheel is moved from a retracted position in the sole or heel of the heeling apparatus to an extended position where at least a portion of the wheel is exposed below the sole for rolling. The retractable wheel may be implemented using any number of designs and/or configurations such as a king pin arrangement, a dual position arrangement using a collapsible axle, a hinged arrangement, or even a spring arrangement.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

It should be understood at the outset that although an exemplary implementation of the present invention is illustrated below, the present invention may be implemented using any number of techniques, materials, designs, and configurations whether currently known or in existence. The present invention should in no way be limited to the exemplary implementations, drawings, and techniques illustrated below, including the exemplary designs and implementations illustrated and described herein.

It should be understood at the outset that although exemplary implementations of the present invention are illustrated below, the present invention may be implemented using any number of mechanisms, arrangements, structures, and/or techniques. Thus, the present invention should in no way be construed to be limited to the exemplary implementations, drawings, and techniques illustrated and described herein.

Figure 1:
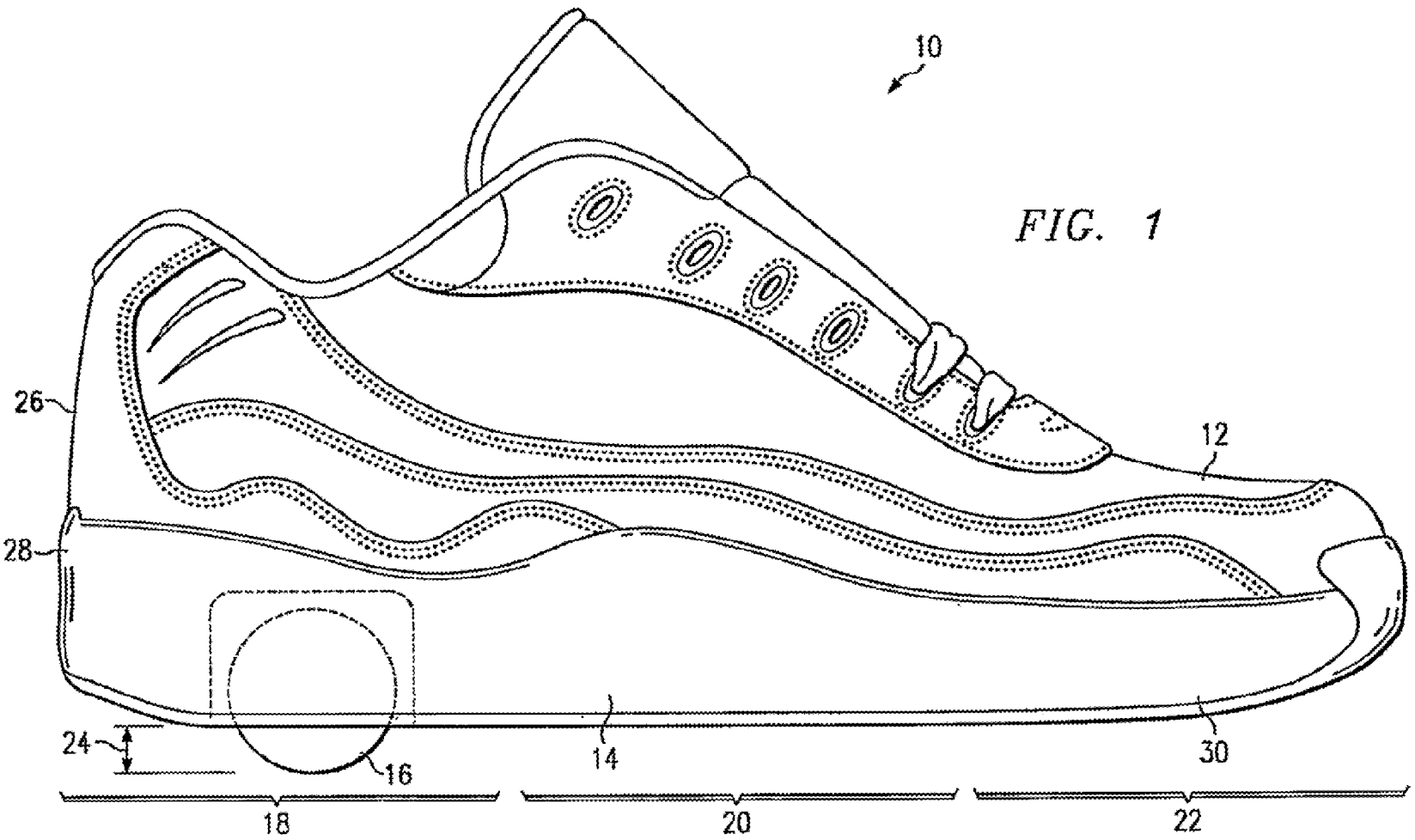
FIG. 1 is a side view that illustrates a heeling apparatus implemented using an athletic shoe according to one embodiment of the present invention.
Figure 1:
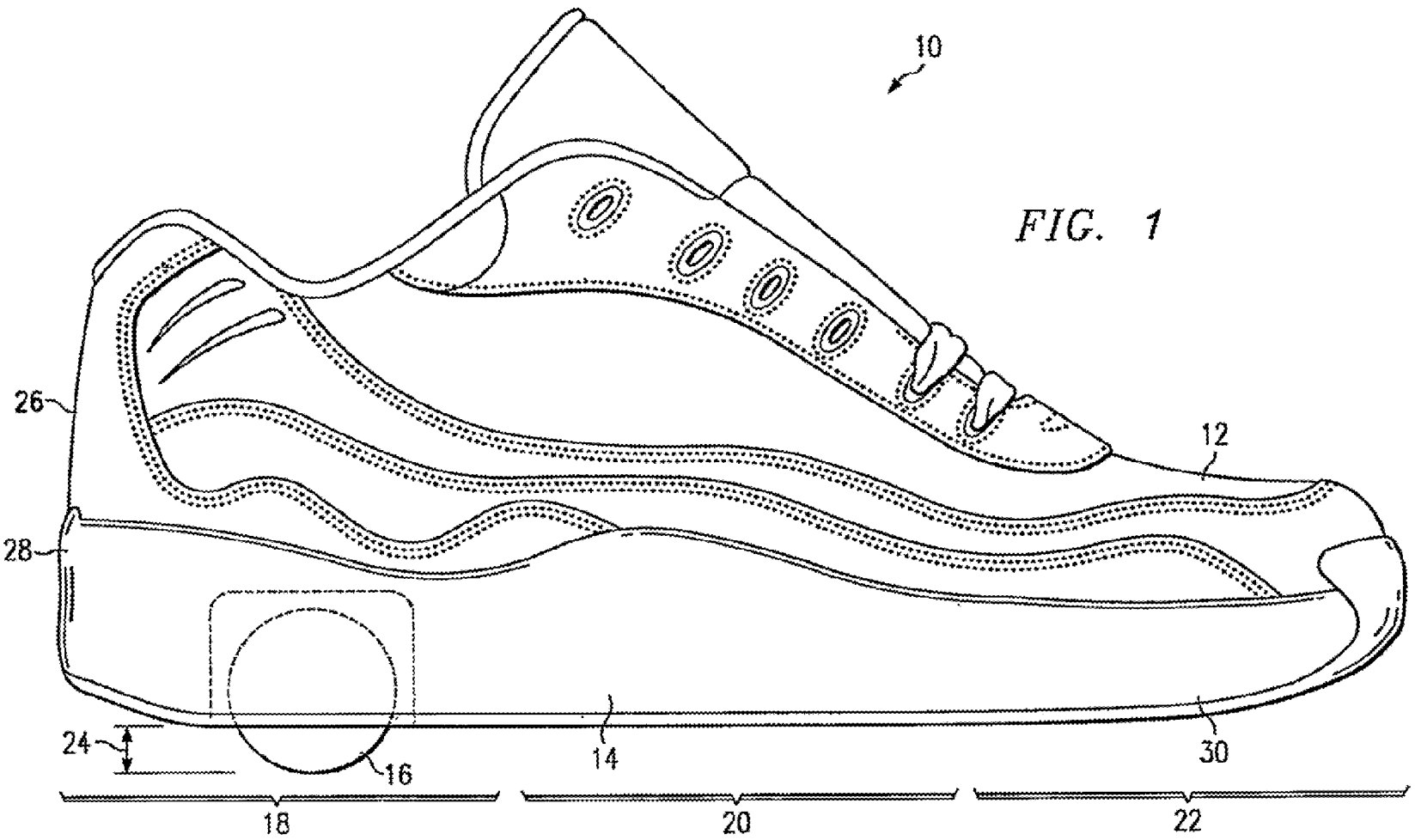
Figure 2A:
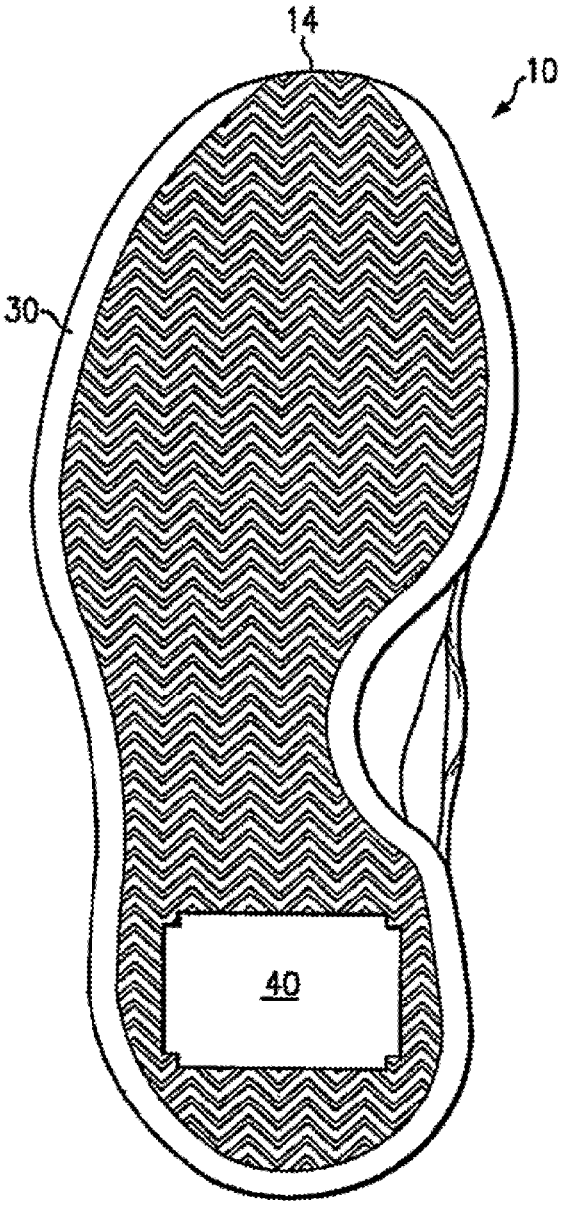
Figure 2B:
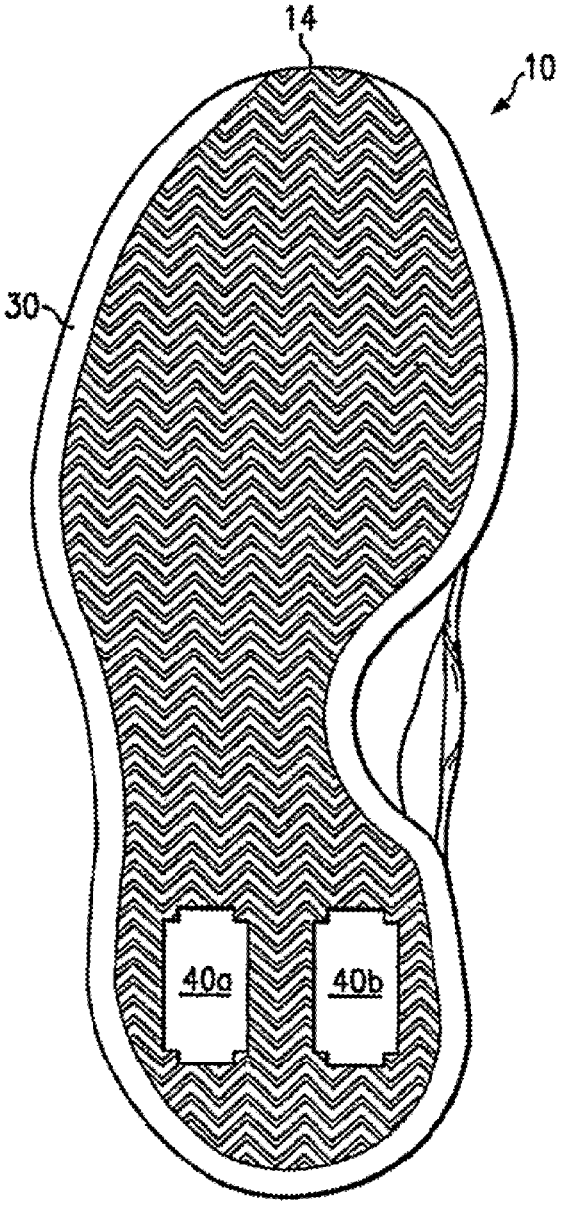

FIG. 1 is a side view of a heeling apparatus 10 implemented using an athletic shoe 12 according to one embodiment of the present invention. The heeling apparatus 10 preferably includes a wheel assembly provided in an opening in the heel portion of the sole of a footwear. For example the athletic shoe 12 includes an opening in the bottom of a heel portion 18 of a sole 14 with a wheel assembly provided in the hole such that a wheel 16 extends below the bottom of the sole 14. The wheel assembly preferably includes at least one wheel, such as the wheel 16, rotatably mounted on an axle (not illustrated in FIG. 1). The wheel 16 mounted on the axle is preferably positioned in the opening of the sole 14 through a mounting structure (not illustrated in FIG. 1) that is operable to support the axle such that a portion of the wheel 16 extends below the heel portion 18 of the sole 14.

The amount or length of the portion of the wheel 16 that extends below the bottom of the sole 14, as defined by a distance 24, will preferably be less than the diameter of the wheel 16. The distance 24, however, may be greater than, less than, or equal to the diameter of the wheel 16.

The athletic shoe 12, as is true of most footwear, may be generally described as having the sole 14 and an upper part 26. The upper part 26 may be constructed of virtually any material such as, for example, leather, plastic, or canvas. The sole 14 may include three parts: (1) an inner sole or insole (not illustrated in FIG. 1); (2) a midsole 28; and (3) an outer sole or outsole 30. The insole may provide added cushion and may or may not be removable. In some embodiments, the insole may include a removable portion, such as a DR. SCHOLL'S insole, and a portion that remains attached to the athletic shoe 12. The outsole 30 will preferably be made of a durable material, such as rubber, and may have a textured surface, such as with knobbies, to provide added traction. The midsole 28 will generally be constructed of a soft or "cushiony" material and will generally be thicker than the insole and the outsole 30. In some embodiments, however, the sole 14 will comprise only one part, such as the leather sole of a loafer. In other embodiments, the sole 14 may include a separate heel block or object that elevates the footwear, such as the heel of a leather wingtip dress shoe. This heel block or object may be considered to be part of the heel portion 18 of the sole 14. It should be understood that the present invention may be implemented in virtually any footwear, irrespective of the design or the make-up of the sole 14. Various styles of footwear and methods of making footwear are known in the art and are known by one of ordinary skill in the art. For example, U.S. Pat. Nos.: 4,245,406, 5,319,869, 5,384,973, 5,396,675, 5,572,804, 5,595,004, and 5,885,500, which are hereby incorporated by reference for all purposes, provide various background information regarding various footwear and methods of making footwear.

In most footwear, including the athletic shoe 12, the sole 14 may also be divided into three portions or regions: (1) the heel portion 18, (2) an arch portion 20, and (3) a forefoot portion 22, as illustrated in FIG. 1. It should be understood that the heel portion 18, the arch portion 20, and the forefoot portion 22 of the sole 14 are incapable of being exactly defined and located, and that such portions vary from one footwear type to another. Thus, the location, the boundaries between, and the size of the heel portion 18, the arch portion 20, and the forefoot portion 22 of the sole 14 are only rough approximations.

It should also be understood that although the position of the opening in the bottom of the sole 14, and hence also the wheel 16, is preferably located in the heel portion 18 of the sole 14, such an opening may also be located at the boundary of the heel portion 18 and the arch portion 20, at the arch portion 20, or at virtually any other location on the sole 14. The opening in the bottom of the sole 14 may extend entirely through the sole 14, e.g., through the outsole, the midsole and the insole, or only partially through the sole 14, e.g., through the outsole, and a portion or all of the midsole.

The wheel 16 may be constructed or made of virtually any known or available material such as, for example, a urethane, a plastic, a polymer, a metal, an alloy, a wood, a rubber, a composite material, and the like. This may include, for example, aluminum, titanium, steel, and a resin. Preferably, the material will be durable, provide quiet performance, and will provide a "soft" or "cushioning" feel. In one embodiment, the wheel 16 may be implemented as one or more precision bearings such that the precision bearing serves as the wheel 16 itself. In yet another embodiment, the wheel assembly may include a spring or suspension such as, for example, a leaf spring, to provide additional cushion or suspension when the wheel 16 contacts a surface and a force is applied to the athletic shoe 12 in the direction of the surface, such as when a someone is wearing and walking in the heeling apparatus 10. The spring is preferably provided as part of the mounting structure of the wheel assembly. In still another embodiment, the wheel 16 is provided as a two piece wheel with an inner core, such as a hard inner core, such as a hard inner core, surrounded by an outer tire, such as a urethane tire.

Depending on the desired implementation, the wheel 16 and the axle may be removable from the wheel assembly. In such a case, a removable cover may be provided in the opening in the sole 14 to cover the opening so that debris and dirt does not enter the opening. The removable cover may be provided in virtually any available configuration readily ascertainable by one of ordinary skill in the art. In one embodiment of the removable cover, an axle portion of the removable cover fits and/or couples to the mounting structure in the same or similar manner that the axle in which the wheel 16 is mounted fits and/or couples to the mounting structure of the wheel assembly. A tool may also be provided to facilitate the removal of the axle and wheel 16. This tool will, preferably, be small and multifunctional to provide any other possible adjustments to the heeling apparatus 10, such as a screw driver, a wrench, and the like. In other embodiments of the heeling apparatus 10, the wheel 16 may be retractable into the opening in the sole 14. In this manner, the wheel 16 may be retracted into the sole 14 and, thus, will not extend below the bottom of the sole 14. This allows the heeling apparatus 10 to function just like ordinary footwear, such as the athletic shoe 12.

Figure 13:
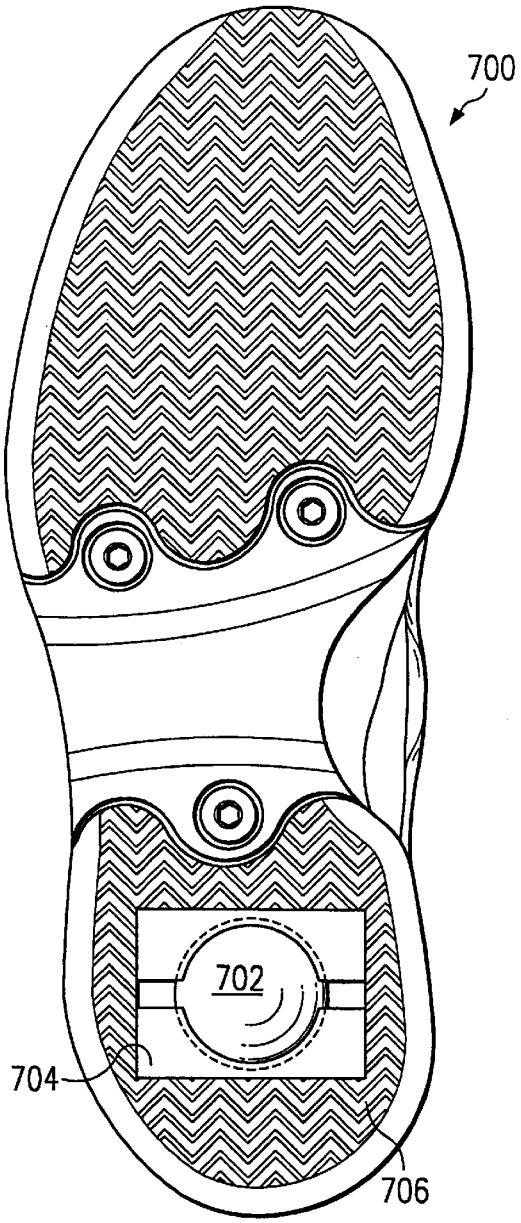
FIG. 13 is a bottom view that illustrates another embodiment of the present invention with a spherical ball serving as a wheel and positioned in a mounting structure in an opening in the heel portion of the sole.

In one embodiment of the present invention, the wheel assembly does not include an axle, and, arguably, not a mounting structure, and the wheel 16 is provided as a sphere, such as a stainless steel ball bearing, that is rotatably positioned in the opening in the bottom of the heel portion 18 of the sole 14, one embodiment of which is shown in FIG. 13. In another embodiment, the wheel assembly comprises an axle positioned completely through or partially through the heel portion 18 of the sole 14 such that the sole 14 supports the axle and the wheel is rotatably mounted on the axle in the opening of the sole 14. In this manner, the need for the mounting structure is eliminated.

Figure 12:
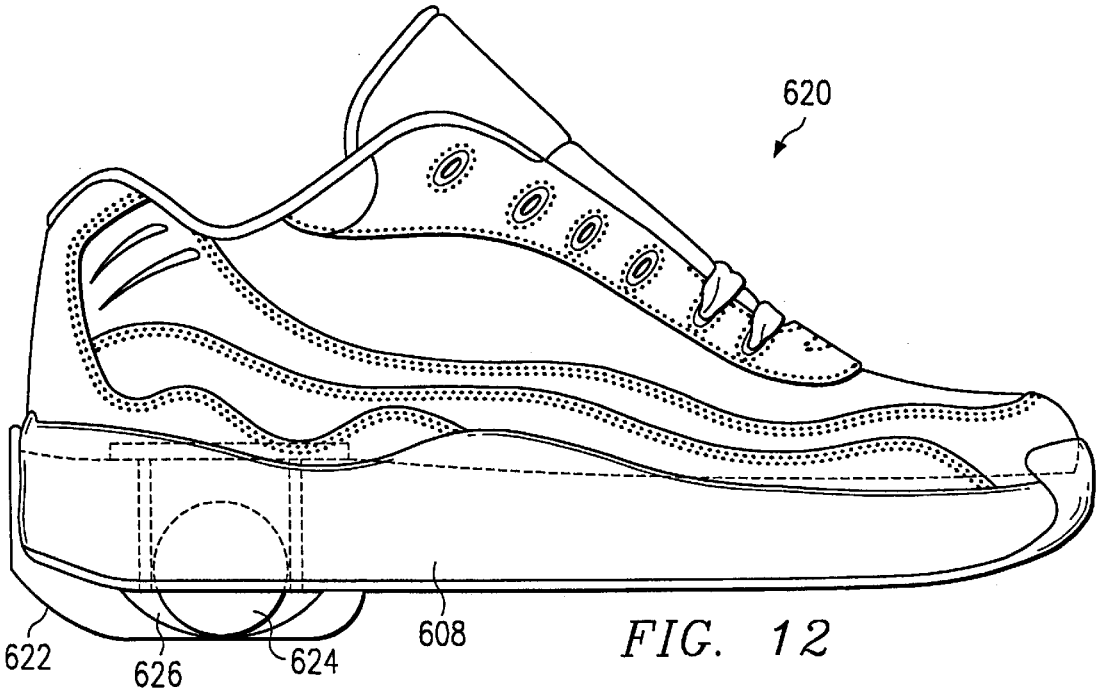
FIG. 12 is a side view of another embodiment that illustrates the heeling apparatus of the present invention with a removable wheel cover positioned to cover the wheel and the opening in the sole.

In operation, a person wearing the heeling apparatus 10 may either walk normally or roll on the wheel 16 by lifting or raising the sole 14 so that only or almost only the wheel 16 contacts a surface. This action may be referred to as "HEELING" or to "HEEL." The wheel 16, depending on the desired implementation of the present invention, may be removed or retracted to a position such that the wheel 16 does not extend below the bottom of the sole 14. This, generally, will result in the heeling apparatus 10 performing like an associated footwear. When the wheel 16 is removed or retracted, a removable cover may be placed over the opening in the bottom of the sole 14 to prevent debris from entering the opening and potentially damaging the wheel assembly. In still other embodiments, a removable cover may be placed over the wheel 16 while a portion of the wheel 16 remains extended below the bottom of the sole 14 to assist with walking, an example of this is illustrated in FIG. 12.

It should be understood, however, that even if the wheel 16 is not removed or retracted as just described, the user may still comfortably walk and run, even with the wheel 16 extended. This generally occurs because the distance 24 can be minimal, which provides a unique "stealth" or "covert" aspect to heeling. This also results in the wheel rolling the opening or hole in the sole 14 of the heeling apparatus 10. In one embodiment, the distance 24 is less than the radius of the wheel 16, which results in most of the wheel residing within the opening of the sole 14.

Figure 2A:
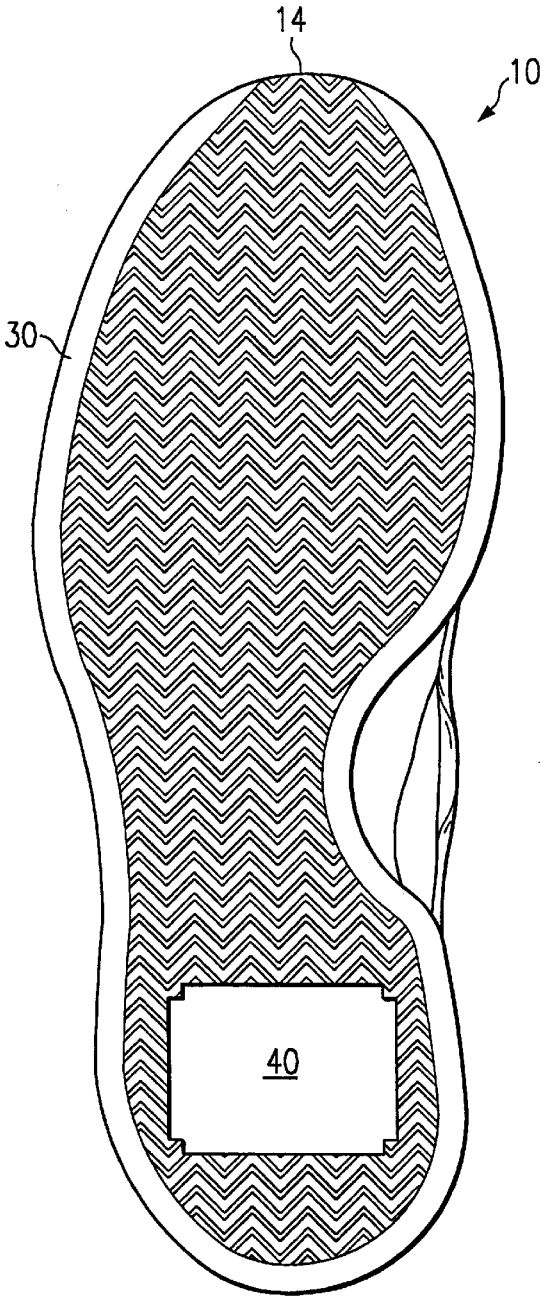
FIGS. 2A and 2B are bottom views that illustrate two embodiments of a sole of the heeling apparatus with openings in the sole.
Figure 2B:
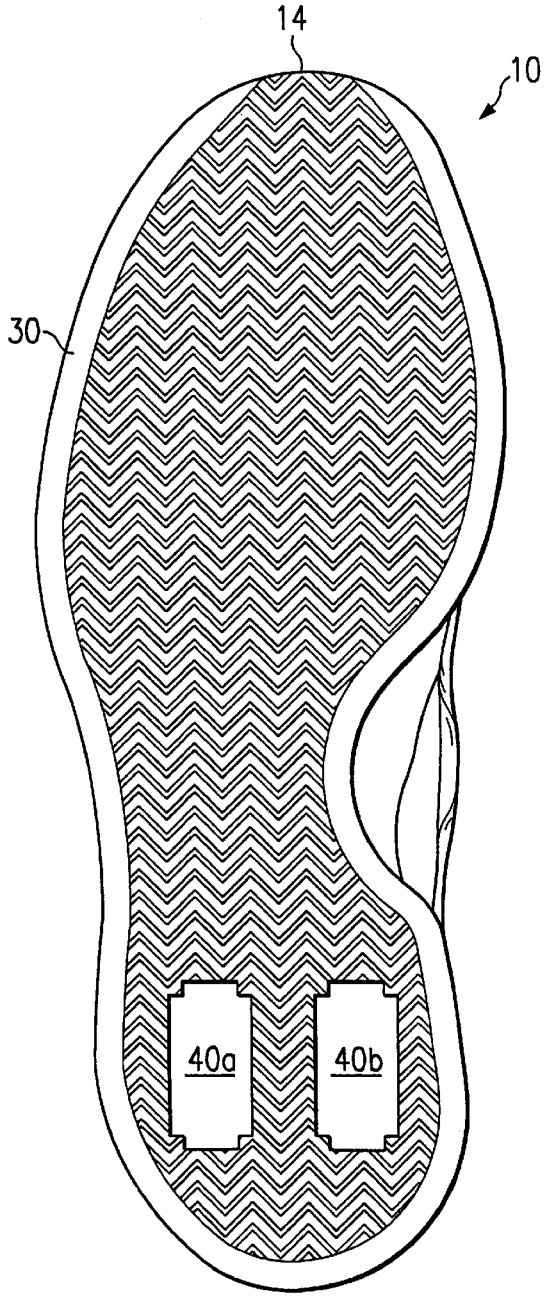

FIGS. 2A and 2B are bottom views of two embodiments of the sole 14 of the heeling apparatus 10. In particular, the outsole 30 or bottom of the sole 14 is illustrated in FIG. 2A with an opening 40 in the heel portion 18 of the sole 14. In the embodiment illustrated, the opening 40 is provided in a square or rectangular configuration. The opening 40, however, may be provided in virtually any configuration, such as, for example, a circular or an elliptical configuration.

As mentioned previously, the opening 40 may extend partially or completely through the sole 14. The opening 40 may be provided through a heel block or object. Further, the opening 40 be positioned in, near, or in a combination of the heel portion 18, the arch portion 20, and the forefoot portion 22.

FIG. 2B illustrates a second embodiment as to the placement and configuration of the opening 40. The outsole 30 is illustrated with an opening 40A and an opening 40B in the heel portion 18 of the sole 14. In this manner, one or more wheels, including one or more axles, may be positioned in both the opening 40A and 40B.

Figure 3A:
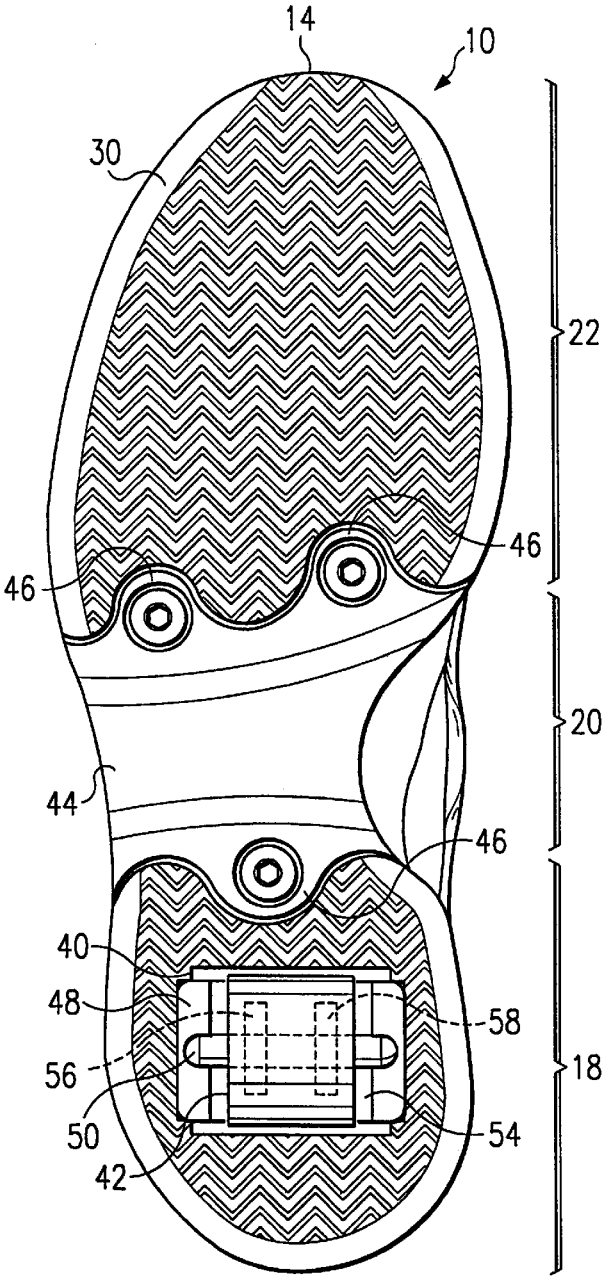
FIGS. 3A and 3B are bottom views of the two embodiments of the sole as shown in FIGS. 2A and 2B and illustrate a wheel in each of the openings of the soles.
Figure 3B:
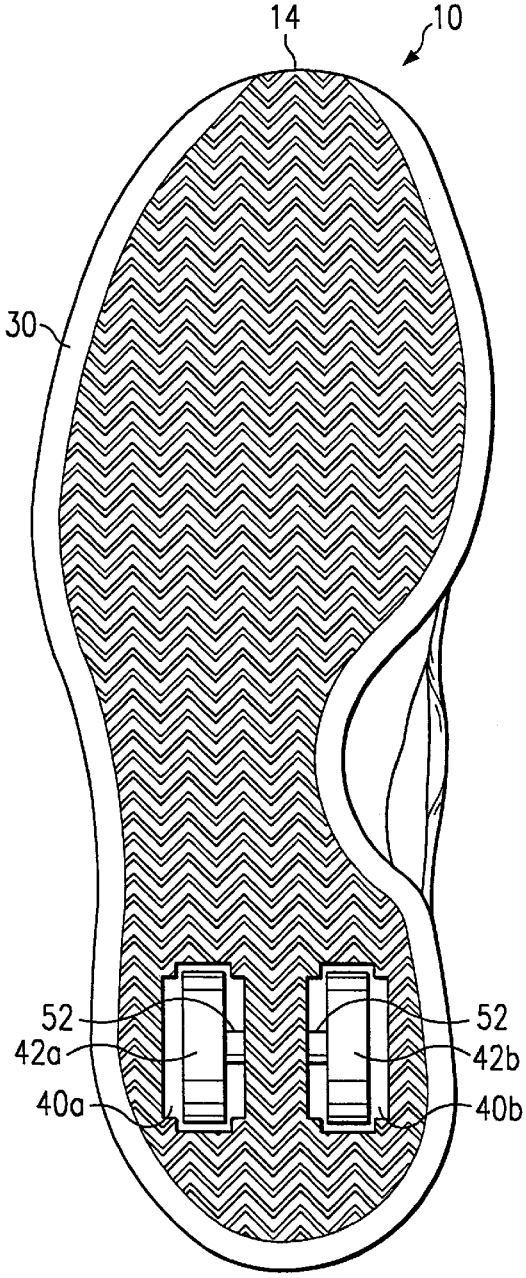

FIGS. 3A and 3B are bottom views of the two embodiments of the sole 14 as shown in FIGS. 2A and 2B and illustrate a wheel in each of the openings of the soles. This includes a wheel 42 positioned in the opening 40 in FIG. 3A and a wheel 42A and a wheel 42B in the openings 40A and 40B, respectively, of FIG. 3B.

The wheel 42 and the wheels 42A and 42B are illustrated as cylindrical wheels. These wheels, however, may be provided in virtually any available configuration. Further, one or more wheels may be positioned in each opening.

FIG. 3A further illustrates other elements of the wheel assembly that include a first member 48 and a second member 54 of a mounting structure that is used to removably couple with an axle 50. The axle 50 extends through the wheel 42 such that the wheel 42 is rotatably coupled or mounted to the axle 50. This preferably involves the use of precision bearings, such as high performance precision bearings, provided in a recess, such as an annular recess, on either side of the wheel 42. A first precision bearing 56 and a second precision bearing 58 may be ABEC grade precision bearings and are illustrated with hidden lines and positioned in the first recess and second recess of the wheel 42. In alternative embodiment, loose ball bearings may be used.

The axle 50 may be made of any material that provides suitable physical characteristics, such as strength and weight, to name a few. The axle 50 is preferably made of hardened steel, is cylindrical in shape, each end is rounded, and is removably coupled with a first member 48 and a second member 54, respectively, of the mounting structure. The removable coupling between each end of the axle 50 and the first member 48 and the second member 54 may be achieved by any known or available mechanism. In a preferred embodiment, a sphere or a ball bearing, preferably using a moveable spring and/or a screw bias, is used to contact and exert a side wall force between one or members of the mounting structure and the axle 50.

It should also be noted that because the weight of the user of the heeling apparatus 10 will exert a significant downward force and the ground or surface will exert an equal force upward, the axle 50, and, hence, the wheel 42 will generally be forced into place. Only when the heel is raised from a surface will any force or friction be required to keep the axle 50 in place. Thus, the present invention does not require a large side force to keep the axle 50 and the wheel 42 in place. The recognition of this fact may be considered an aspect of the present invention for the embodiment as showm. This recognition allows the removable coupling between each end of the axle 50 and the first member 48 and the second member 54 to be optimally designed.

FIG. 3A also illustrates a grind plate 44 (which also may be referred to as a slide plate 44) that may be used in conjunction with the heeling apparatus 10 of the present invention. The grind plate 44 provides a smooth or relatively smooth surface to allow a user to "grind" or "slide" on various surfaces such as hand rails, curbs, steps, corners, and the like. The grind plate 44 is preferably somewhat thin and made of a plastic or polymer material. In a preferred embodiment, the grind plate 44 is removably attached to the arch portion 20 of the outsole 30 of the sole 14. The grind plate 44 may be attached using any known or available fastener, such as, for example, a fastener 46 shown in various locations around the periphery of the grind plate 44.

FIG. 3B further illustrates an axle 52 in which the wheel 42A and the wheel 42B are coupled to either end in the opening 40A and the opening 40B, respectively. The axle 52 extends through both the wheels 42A and 42B and through a portion of sole 14, not visible in FIG. 3B. This serves to support the axle 52 and illustrates the situation where the sole 14 serves as the mounting structure of the wheel assembly. This reduces the overall number of parts. In an alternative embodiment, a metal or some other suitable material may be used within the heel portion 18 of the sole 14 where the axle 52 is positioned to provide additional support and stability. This is an example where the mounting structure is, in effect, integrated into the sole 14. As can be appreciated by one skilled in the art, the present invention may be implemented in any number of ways.

Figure 4:
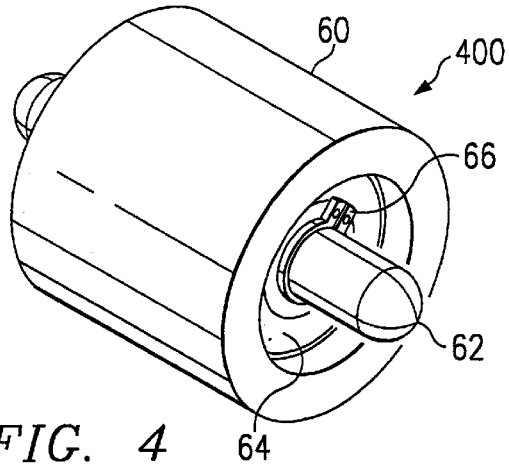
FIG. 4 is a perspective view that illustrates a wheel rotatably mounted to an axle, which also may be referred to as a wheel/axle assembly, for use in a wheel assembly according to one embodiment of the present invention.

FIG. 4 is a perspective view of a wheel 60 rotatably mounted on an axle 62, which also may be referred to as a wheel/axle assembly, for use in a wheel assembly, or in a heeling apparatus, according to one embodiment of the present invention. The wheel 60 and the axle 62 may also be referred to as a wheel/axle assembly 400. In this embodiment, the axle 62 extends through the wheel 60 and includes two ends that are rounded or bullet shaped. A precision bearing 64 is shown positioned in a recess, which is shown as an annular recess, of the wheel 60 to facilitate the rotation of the wheel 60 around the axle 62. Preferably a second precision bearing is positioned in a second recess, not shown in FIG. 4, to further facilitate such rotation.

A slip clip, slip ring, or ring clip 66 is shown positioned around, or nearly around, the axle 62 near the precision bearing 64. This serves to ensure that the precision bearing 64 remains in place in the recess of the wheel 60. The slip clip or ring clip 66 will preferably be positioned on the axle 62 through a groove, such as a radial groove or radial indentation, in the axle 62. It should be understood, however, that one of ordinary skill in the art may use any of a variety of other arrangements to ensure that the precision bearing 64 stays in position. In alternative embodiments, the precision bearing 64 may be eliminated or loose bearings may be used.

The wheel 60 rotatably mounted on the axle 62 may, in alternative embodiments, serve as the wheel assembly of the present invention. In such a case, the axle 62 may be mounted to the sole, such as the midsole and heel portion, at its ends while the wheel 60 is rotatably provided in the opening of the sole. In this manner, the need for a mounting structure may be thought of as eliminated or, alternatively, the mounting structure may be thought of as integrated into the sole of the footwear.

Figure 5:
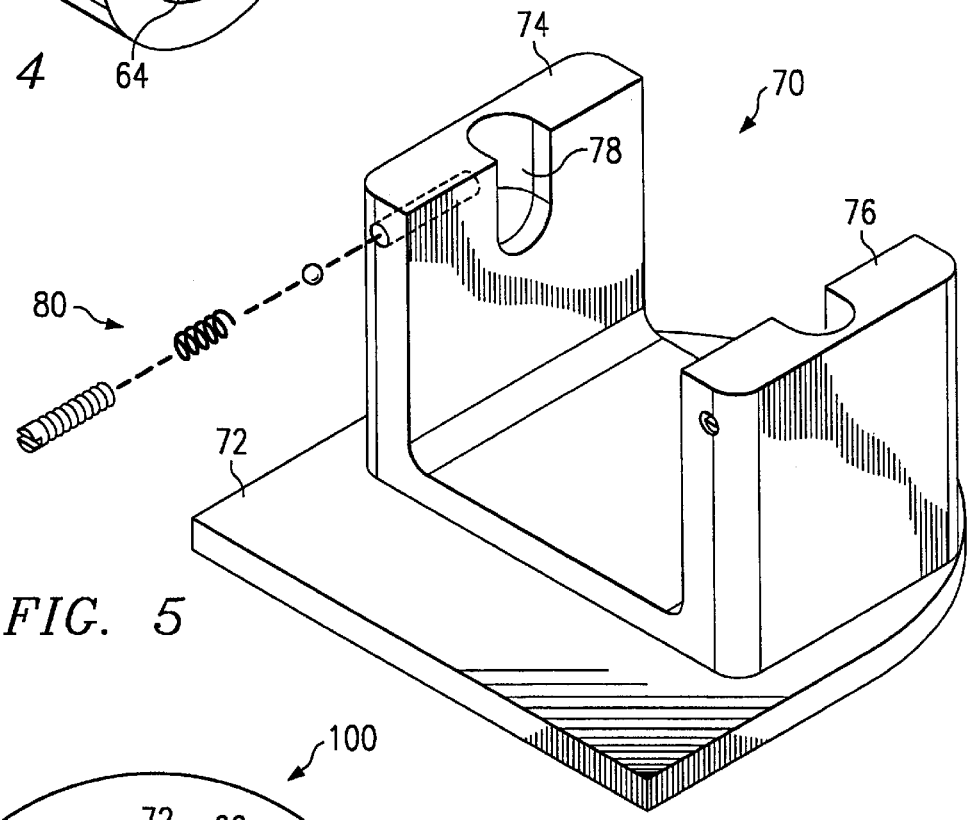
FIG. 5 is a perspective view that illustrates a mounting structure for use with a wheel rotatably mounted to an axle, as illustrated in FIG. 4, to form a wheel assembly.

FIG. 5 is a perspective view of a mounting structure 70 for use with a wheel rotatably mounted to an axle, such as is illustrated in FIG. 4, to form a wheel assembly. The mounting structure 70 generally includes a heel control plate 72, a first member 74, and a second member 76. In alternative embodiments, a spring, such as a leaf spring, could be provided where the two members contact the heel control plate 72. This would provide the added benefit of greater cushion and suspension. The two members include an opening, such as the opening 78 of the first member 74 to receive an end of an axle. It should be mentioned that the opening may be provided in virtually any configuration, including extending through the member, or placed at different positions, or even multiple positions for mounting the wheel/axle assembly 400 at a retractable position and an extended position, on the member.

The axle that is to be positioned in the openings of the first member 74 and the second member 76 will preferably be removably coupled. This may be achieved by any number of arrangements and configurations, all of which fall within the scope of the present invention. One such arrangement is the screw/spring/ball bearing arrangement 80 provided in first member 74. This arrangement provides an adjustable bias or force that can be exerted against the axle when it is inserted into the opening 78. The screw is accessible and adjustable by the user. The turning of the screw affects the compression of a spring which, in turn, provides a force on a ball bearing that extends out into the opening 78. When the axle is inserted into the opening 78, the ball bearing may be displaced an amount and the screw/spring/ball bearing arrangement 80 will provide a side force to allow the axle to be secure, yet removable. A similar arrangement may also be provided in the second member 76 to provide a friction fit or coupling on the other end of the axle 62.

Figure 6:
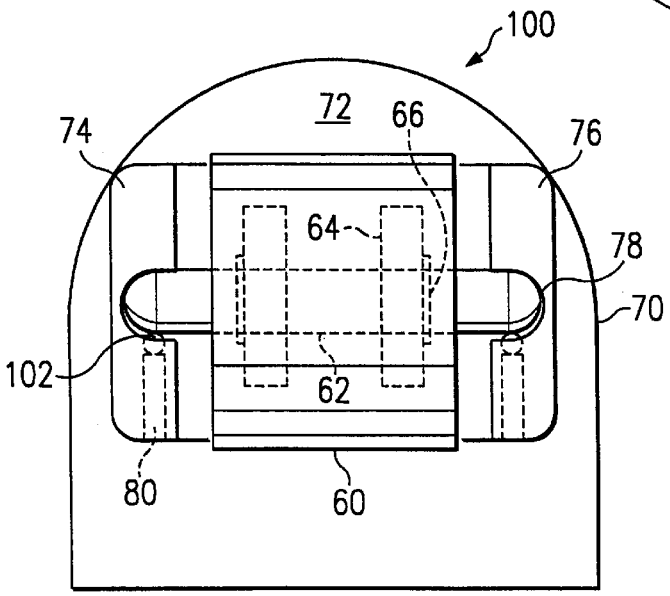
FIG. 6 is a bottom view that illustrates a wheel assembly that includes the wheel rotatably mounted on the axle as shown in FIG. 4 and the mounting structure of FIG. 5.

Although the screw/spring/ball bearing arrangement 80 of FIG. 5 is shown being implemented through a horizontal opening in the first member 74, it may be implemented in using an opening aligned in virtually in manner in the member. For example, the adjustment of the tension or pressure on the screw/spring/ball arrangement 80 may be achieved through a diagonal opening such that the exposed end of the screw/spring/ball arrangement 80, normally a screw head end, is provided where the reference line for numeral 74 in FIG. 5 contacts the first member 74. This provides easier access to adjust the tension and friction fit on the axle 62 when the wheel assembly, such as wheel assembly 100 of FIG. 6, is engaged or positioned within the opening of a sole to form a heeling apparatus. Of course, any of a variety of other arrangements, configurations, and opening alignments may be contemplated and implemented under the present invention.

The mounting structure 70 can be made or constructed of virtually any material, generally depending on the desired mechanical characteristics such as, for example, rigidity and strength. These materials may include, for example, a plastic, a polymer, a metal, an alloy, a wood, a rubber, a composite material, and the like. This may include aluminum, titanium, steel, and a resin. In one embodiment, the mounting structure 70 is made of a metal, such as aluminum, that has been anodized such that the mounting structure 70 presents a black color or hue.

FIG. 6 is a bottom view of a wheel assembly 100 that includes the wheel 60 rotatably mounted to the axle 62, as shown in FIG. 4, and the mounting structure 70 of FIG. 5. The first member 74 and the second member 76 each removably couple with the ends of the axle 62 through a bias mechanism implemented using a bias mechanism, such as the screw/spring/ball bearing arrangement 80. A ball bearing 102 is shown contacting one end of the axle 62 in the opening 78. Further slip clips or ring clips (which may also be referred to as snap rings or slip rings), such as ring clip 66, are provided to ensure that the precision bearings positioned in the recesses of the wheel remain in position.

The heel control plate 72 allows the user of the heeling apparatus to gain greater control and to obtain greater performance out of the heeling apparatus.

Figure 7:
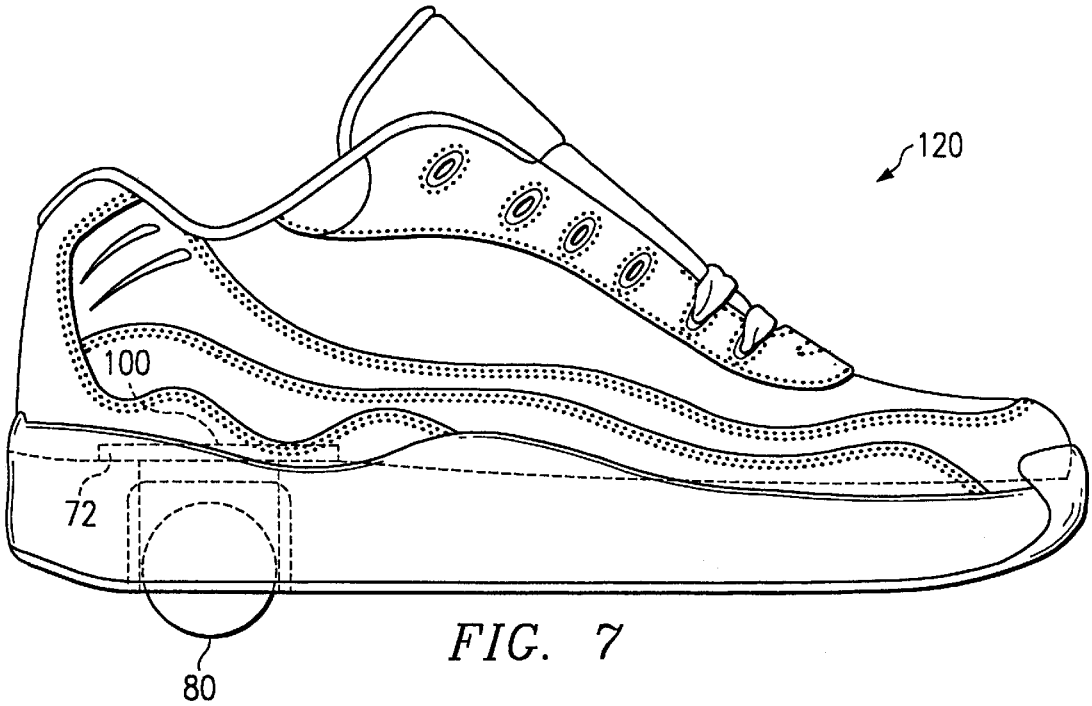
FIG. 7 is a side view that illustrates the wheel assembly positioned above and through the opening in a footwear to form a heeling apparatus.

FIG. 7 is a side view of the wheel assembly 100 positioned above and through the opening to form a heeling apparatus 120. The heel control plate 72 resides inside the shoe so that the heel of the user may apply pressure to the heel control plate as desired to provide better handling and performance of the heeling apparatus 120.

Figure 8A:
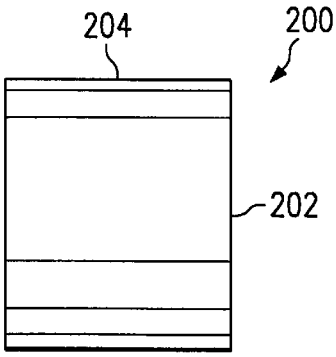
FIGS. 8A, 8B, 8C, and 8D are profile views of various wheels that illustrate the surface profile of these wheels that may used in various embodiments of the present invention.
Figure 8B:
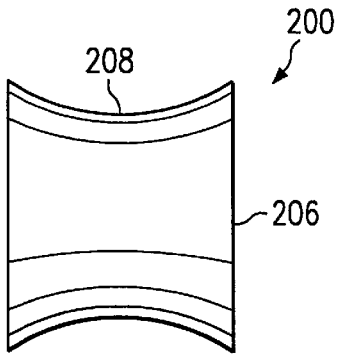
Figure 8C:
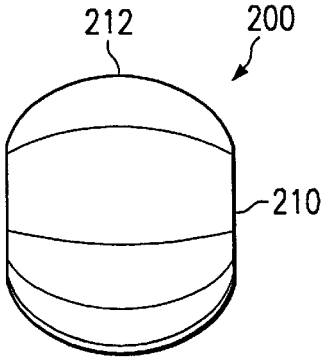
Figure 8D:
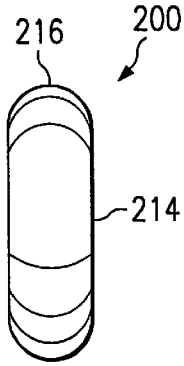

FIGS. 8A, 8B, 8C, and 8D are profile views of various wheels 200 that illustrates the surface profile of these wheels that may used in various embodiments of the present invention. In FIG. 8A, a wheel 202 is shown with a flat or square surface or exterior profile 204. In FIG. 8B, a wheel 206 is shown with an inverted surface profile 208. In FIG. 8*c*, a wheel 210 is shown with round surface profile 212. Finally, in FIG. 8D, a wheel 214 is shown with a steep surface profile 216. The present invention may incorporate virtually any available surface profile of a wheel.

Figure 9:
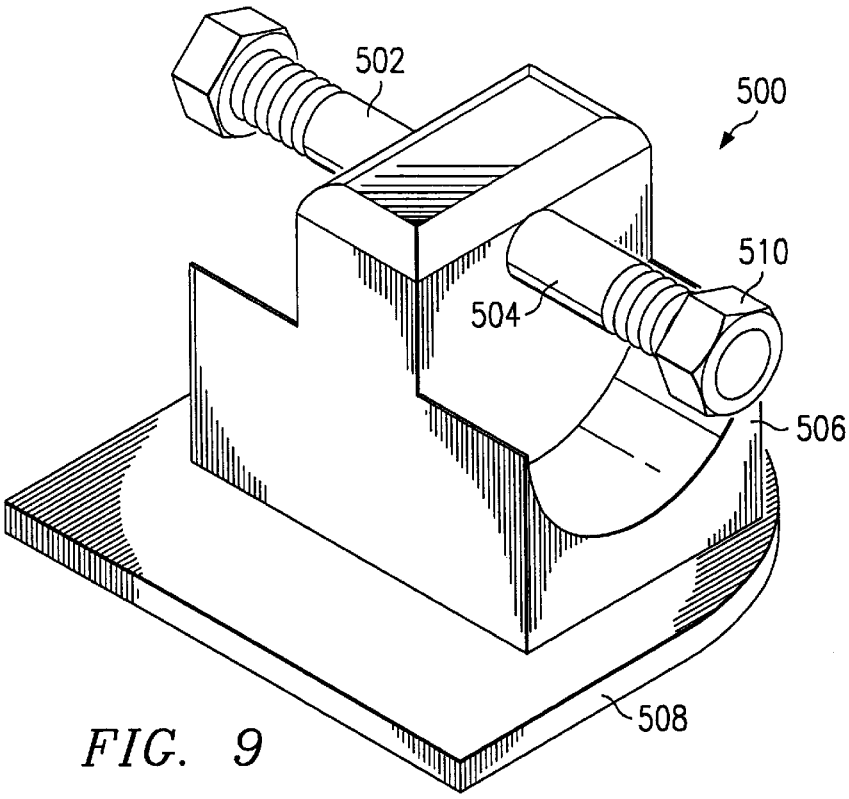
FIG. 9 is a perspective view that illustrates a mounting structure of another embodiment for use in a wheel assembly of a heeling apparatus.

FIG. 9 is a perspective view that illustrates a mounting structure 500 of another embodiment for use in a wheel assembly of a heeling apparatus. The mounting structure 500 includes an axle 502, which may be considered one axle that extends through and is mounted through a member 50 or as an axle 502 that couples with the member 506 along with an axle 504 that couples with the member 506 opposite axle 502. The mounting structure 500 also includes a heel control plate 508 coupled with the member 506.

The mounting structure 500 allows for two wheels to be mounted to form a wheel assembly. A wheel may be rotatably mounted on the axle 502, preferably using a precision bearing, and a wheel may be rotatably mounted on the axle 504, also preferably through a precision bearing as illustrated previously herein.

Figure 10:
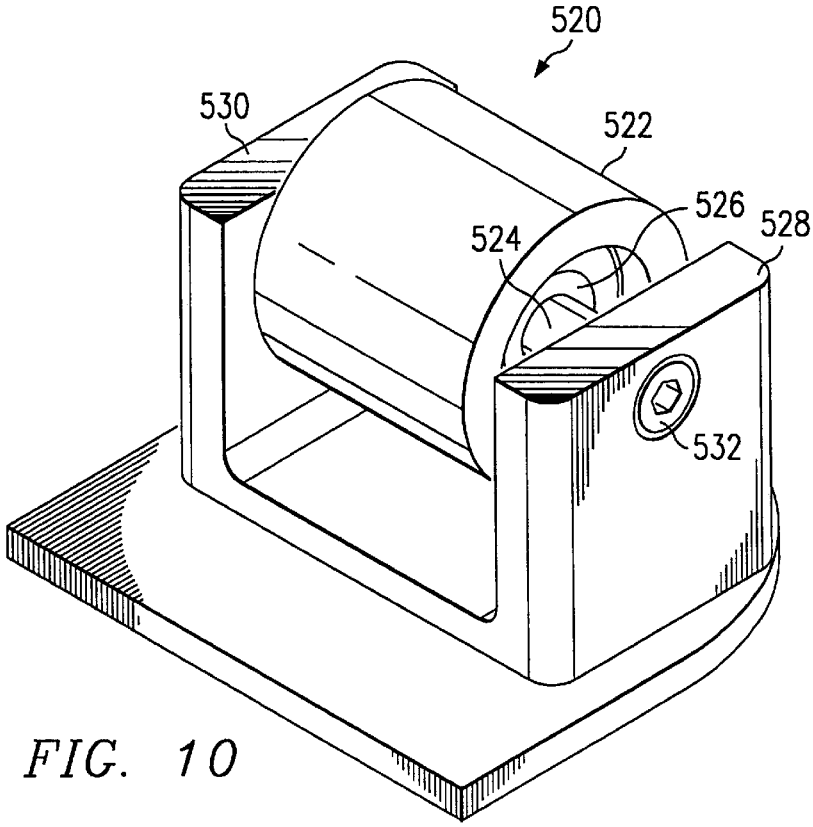
FIG. 10 is a perspective view that illustrates a wheel assembly that uses yet another embodiment for use in a heeling apparatus.

The axle 502 and the axle 504 include a threaded portion such that a nut, such as a lock nut 510 may be included to secure a wheel to each axle. In other embodiments, the end of the axles may include internal threads, as opposed to external threads as shown, so that a screw, such as the hex screw as shown in FIG. 10. It should be understood that virtually any available coupling may be provided between the axle and the member.

FIG. 10 is a perspective view that illustrates a wheel assembly 520 that uses yet another embodiment for use in a heeling apparatus and includes a wheel 522 rotatably mounted to an axle 524 using a precision bearing 526, and a first member 528 and a second member 530 coupled to each end of the axle 524 through a screw, such as hex screw 532. The wheel assembly 520 is similar to wheel assembly 100, which was described above in connection with FIG. 6, except that the wheel/axle assembly cannot be as easily inserted and removed.

Figure 11:
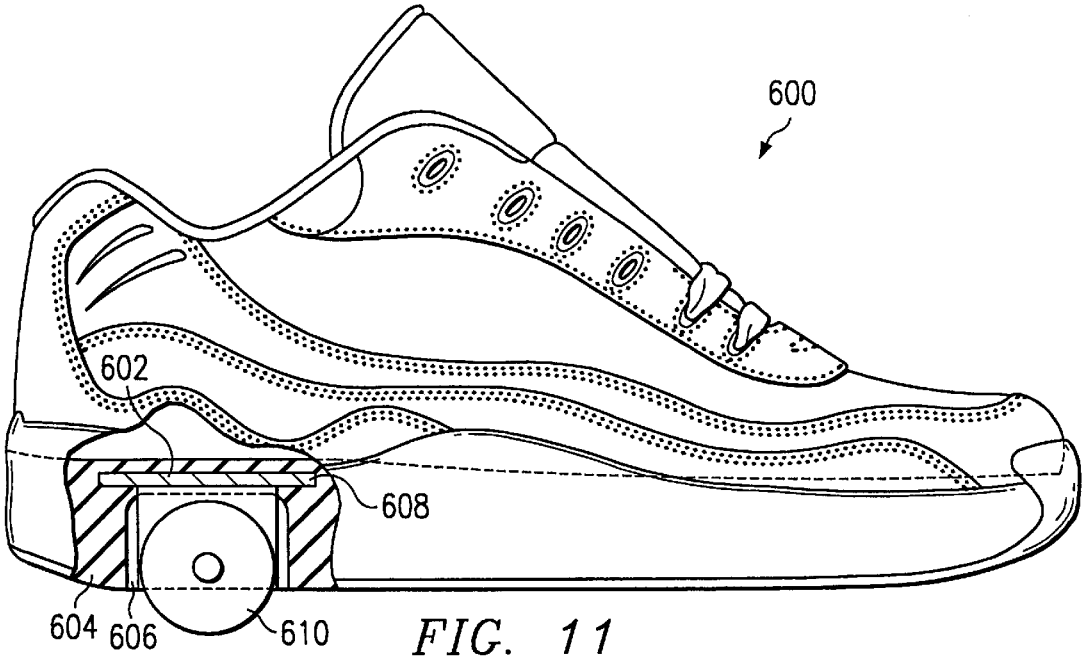
FIG. 11 is a side, partial cutaway view that illustrates one embodiment of a heeling apparatus that illustrates the wheel assembly provided in the sole of the heeling apparatus and the opening in the sole not extending completely through the sole.

FIG. 11 is a side, partial cutaway view that illustrates one embodiment of a heeling apparatus 600 that illustrates a wheel assembly 602 provided in a sole 604 and an opening 606 in the sole 602 that does not extend completely through the sole 602. As such, the mounting structure 608 may be provided or integrated into the sole 602 and may not be readily or easily removed. A wheel 610 is also shown extending partially below the bottom of the sole 602, which provides the advantage of stealth heeling.

FIG. 12 is a side view of another embodiment that illustrates a heeling apparatus 620 of the present invention with a removable wheel cover 622 positioned to cover a wheel 624 and an opening 626 in a sole 628. The removable wheel cover 622 allows for the wheel to be provided in an extended position, i.e., below the bottom surface of the sole 628, yet not engage a surface to roll. Although the heeling apparatus 620 of the present invention allows a user to walk and run, even with the wheel in an engaged position, the removable wheel cover 622 provides protection from dirt and debris and provides greater stability.

In an alternative embodiment, a wheel stop, not expressly shown in FIG. 12, may be provided, in lieu of or in conjunction with the removable wheel cover 622, to stop the rotation of the wheel 624. In one embodiment, the wheel stop is made of virtually any material, such as a sponge or flexible material, that can be wedged between the wheel 624 and the opening 626 to stop or prevent the rotation of the wheel 624 and to stay in place through friction.

In other embodiments of the wheel cover 622, a wheel cover is provided when the wheel 624 has been removed from the heeling apparatus 620. In a preferred embodiment, this wheel cover is generally flush with the remainder of the bottom of the sole 608, and, hence, provides the function of a regular shoe when desired and protects the opening. This wheel cover may couple in any available manner, but preferably will couple to the wheel assembly in the same or similar manner that the wheel/axle assembly couples to the mounting structure. The removable wheel cover could clip or attach to the wheel assembly in many different ways.

FIG. 13 is a bottom view that illustrates another embodiment of a heeling apparatus 700 with a spherical ball 702 serving as a wheel and positioned in a mounting structure 704 in an opening in the heel portion of the sole 706.

Figure 14:
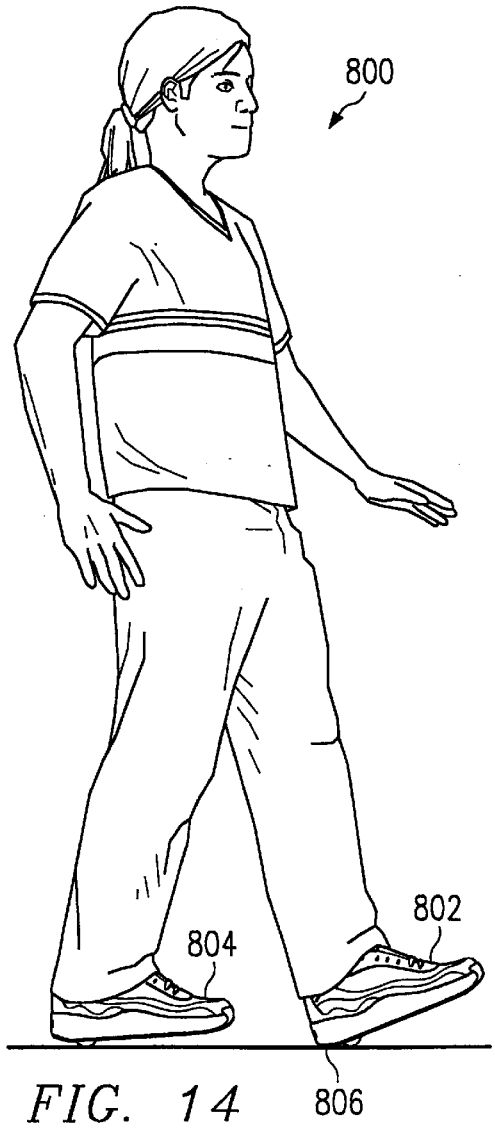
FIG. 14 is a perspective view that illustrates a "heeler" using the present invention to "heel"

FIG. 14 is a perspective view that illustrates a "heeler" 800 using the present invention to "heel." Heeling can be achieved using various techniques and, generally, requires a skill set of balance, positioning, flexibility, and coordination.

An illustrative method for using a heeling apparatus on a surface may include running on a surface by using a forefoot portion of a sole of the heeling apparatus to contact the surface, and then rolling on the surface with a wheel of the heeling apparatus extended below the bottom of the sole through an opening in the sole by using a wheel of the heeling apparatus to contact the surface. Before running on a surface, the method may include walking on the surface while wearing the heeling apparatus with a wheel of the heeling apparatus extended below the bottom of a sole portion of the heeling apparatus before running on the surface. Heeling may also be performed on a hill or a surface that includes a decline.

The method of heeling may also include engaging the wheel of the heeling apparatus to extend below the bottom of the sole portion of the heeling apparatus before walking on the surface. The method may also include walking on the surface while wearing the heeling apparatus before engaging the wheel of the heeling apparatus and with the wheel of the heeling apparatus retracted. Other variations on the method may include transitioning from rolling on the surface to either running, walking, or stopping on the surface by running on the surface through using the forefoot portion of the sole of the heeling apparatus to contact the surface just after rolling on the surface.

The preferred position while heeling is illustrated by the heeler 800 in FIG. 14 where one heeling apparatus 802 is placed in front of the other heeling apparatus 804 while rolling on a surface. As can be seen from a back heel portion 806 of the heeling apparatus 804, sometimes the clearance between the back heel portion 806 and the surface is small. As a result, in a preferred embodiment, the back heel portion 806 is made of a wear resistant material.

The method of heeling may also implement any number of techniques for slowing or stopping. For example, rolling may be slowed by contacting the forefoot portion of the sole of the heeling apparatus to contact the surface to create friction and to remove the wheel from the surface. Another example includes slowing by contacting a heel portion of the sole of the heeling apparatus to contact the surface.

Figure 15:
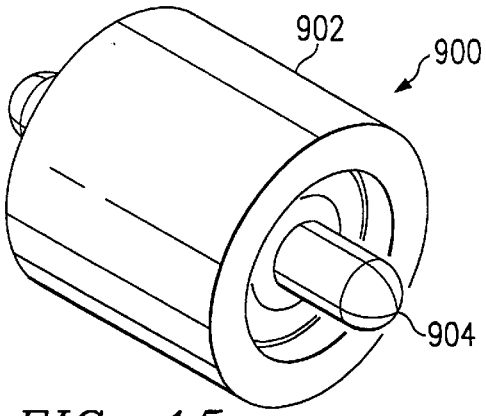
FIG. 15 is a perspective view that illustrates a wheel rotatably mounted to an axle, which also may be referred to as a wheel/axle assembly, similar to FIG. 4.
Figure 16:
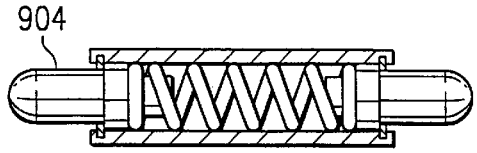
FIG. 16 is a cutaway view that illustrates a collapsible axle of the wheel/axle assembly of FIG. 15 implemented as a spring loaded collapsible axle.

FIG. 15 is a perspective view that illustrates a wheel 902 rotatably mounted to a collapsible axle 904, which also may be referred to as a wheel/axle assembly 900, similar to FIG. 4. The collapsible axle 904 may be implemented in any number of ways, such as an adjustable axle that is spring loaded, similar to what is shown in FIG. 16, or as a screw collapsible axle. This allows the wheel/axle assembly 900 to be more easily removable and/or retractable to a position where the wheel would not engage the ground if the wheel/axle assembly 900 where implemented in a heeling apparatus.

FIG. 16 is a cutaway view that illustrates a collapsible axle 904 of the wheel/axle assembly 900 of FIG. 15 implemented as a spring loaded collapsible axle. As can be seen, the collapsible axle 904 may be adjusted or shortened by inwardly compressing both ends of the collapsible axle 904 to overcome the internal spring force.

Figure 17:
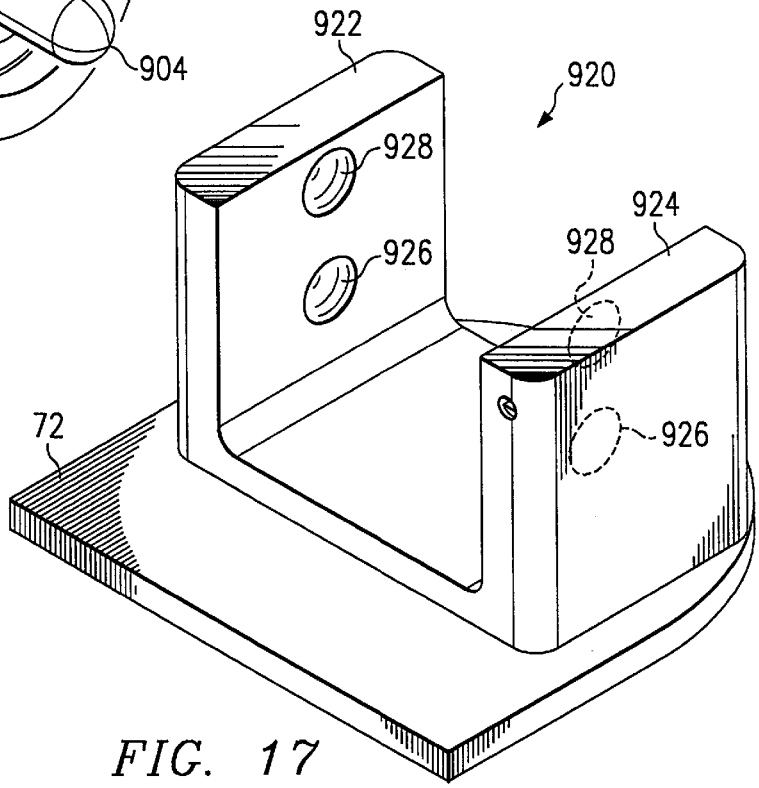
FIG. 17 is a perspective view that illustrates another mounting structure for use with the wheel/axle assembly and the collapsible axle, as illustrated in FIG. 15 and FIG. 16, to form a wheel assembly.

FIG. 17 is a perspective view that illustrates another mounting structure 920 for use with the wheel/axle assembly 900 and the collapsible axle 904, as illustrated in FIG. 15 and FIG. 16, respectively, to form a wheel assembly. The collapsible axle 904 may couple to a first member 922 and a second member 924 at a first position 926 at the first member 922 and the second member 924 so that the wheel is in a retracted position. The collapsible axle 904 may also couple to the first member 922 and the second member 924 at a second position 928 so that the wheel is in an extended position.

Figure 18:
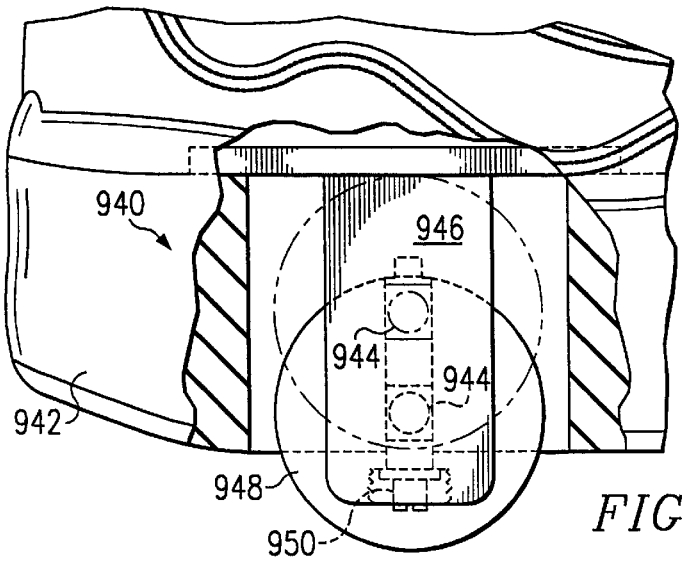
FIG. 18 is a side, cutaway view that illustrates a wheel assembly positioned through an opening in a sole that illustrates one embodiment of an axle that couples to the mounting structure to provide a retractable wheel using an assembly that may be referred to as a king pin arrangement.

FIG. 18 is a side, cutaway view that illustrates a wheel assembly 940 positioned through an opening in a sole 942 that illustrates one embodiment of an axle 944 that couples to a mounting structure 946 to provide a retractable wheel 948 using an assembly that may be referred to as a king pin arrangement or dual king pin arrangement. This allows the retractable wheel 948 to be adjusted up or down, as desired, and from a retractable position to an extended position. A king pin 950 (which may be implemented as a threaded screw or bolt) is shown threadingly engaged in a threaded opening in a member of the mounting structure 946. As the king pin 950 is screwed further into the opening in the member, the axle 944 is further retracted. A king pin 950 will also be provided at the other member to raise the other side of the axle 944. In other embodiments, such as the mounting structure 500 in FIG. 9, a single king pin could be provided through the single member to provide retractable wheels through the coupling of the members and the axle.

An example of a king pin type assembly is illustrated in U.S. Pat. No. 4,295,655, which is incorporated herein by reference for all purposes, issued to David L. Landay, et al., was filed on Jul. 18, 1979, was issued Oct. 20, 1981. This patent illustrates a king pin type assembly that could be implemented in an embodiment of the present invention.

Figure 19:
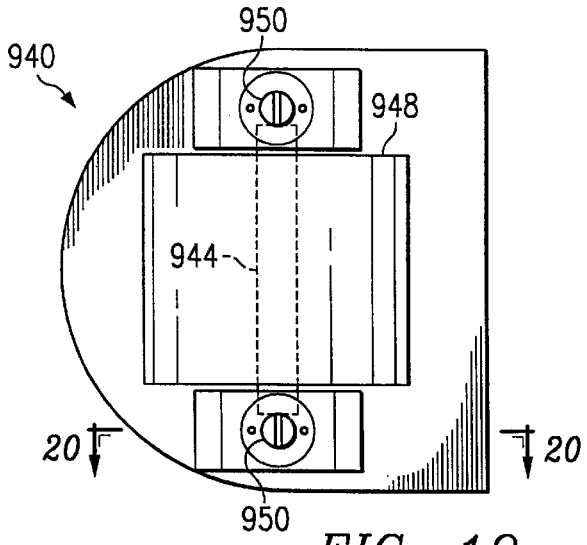
FIG. 19 is a bottom view that illustrates the wheel assembly of FIG. 18 that further illustrates the dual king pin arrangement.

FIG. 19 is a bottom view that illustrates the wheel assembly 940 of FIG. 18 and further illustrates the dual king pin arrangement and the king pins 950 through the members of the mounting structure 946.

Figure 20:
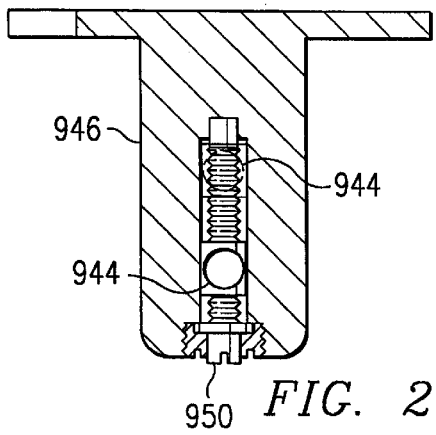
FIG. 20 is a side view that illustrates one member of the mounting structure that further illustrates the coupling of the axle to the mounting structure using the dual king pin arrangement.

FIG. 20 is a side view that illustrates one member of the mounting structure 946 and further illustrates the coupling of the axle 944 to the mounting structure 946 using the dual king pin arrangement similar to FIG. 18. As discussed above, this allows the axle 944, and hence the attached wheel, to be transitioned to any of a desired levels, and from a retracted position to an extended position.

It should be understood that the axle may couple to a member of a mounting structure using any available technique and in virtually an unlimited number of ways. For example, an axle may couple to the first member and the second member of a mounting structure to move from a retracted position to an extended position through a spring arrangement. Similarly, an axle may couple to the first member and the second member of a mounting structure to move from a retracted position to an extended position through a hinged arrangement.

Many other examples are possible, for example U.S. Pat. No. 3,983,643, which is incorporated herein by reference for all purposes, issued to Walter Schreyer, et al., was filed on May 23, 1975, was issued Oct. 5, 1976 illustrates a retractable mechanism that may implemented in one embodiment of the present invention. U.S. Pat. No. 5,785,327, which is incorporated herein by reference for all purposes, issued to Raymond J. Gallant, was filed on Jun. 20, 1997, issued on Jul. 28, 1998 illustrates simultaneously retractable wheels.

Figure 21:
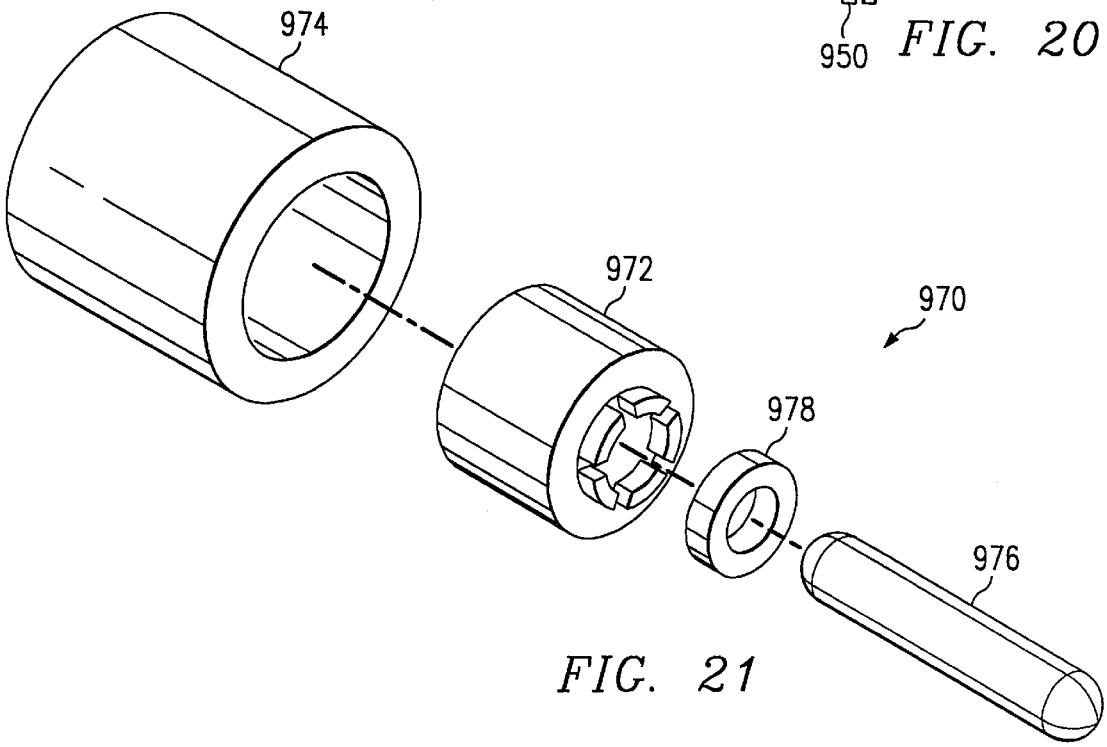
FIG. 21 is a breakaway and perspective view that illustrates a two piece wheel that includes an inner core and an outer tire and that may be used in the present invention.

FIG. 21 is a breakaway and perspective view that illustrates a two piece wheel 970 that includes an inner core 972, an outer tire 974, such as a urethane wheel, an axle 976 (which may not be shown to skill), and a bearing 978 that may be used in the present invention. In a preferred embodiment, the bearing 978 is small in comparison to the two piece wheel 970, for example, the bearing 978 may have an outer diameter that is less than half the outer diameter of the outer tire 974. This can provide significant advantages, that include a softer ride, better control, and are longer lasting. This is because the outer tire 974 can be larger and thicker. In other embodiments, the bearing 978 is larger and has an outer diameter that is more than half the outer diameter of the outer tire 974. In a preferred embodiment, the inner core portion of the two piece wheel is made of a harder material that provides rigidity for enhanced bearing support, while the outer tire portion is made of a softer material, such as a soft urethane, for improved performance and a quieter ride. These types of wheels may be referred to as a "dual durometer" type wheel.

Thus, it is apparent that there has been provided, in accordance with the present invention, a heeling apparatus and method that defines a new activity and sport that satisfies one or more of the advantages set forth above. Although the preferred embodiment has been described in detail, it should be understood that various changes, substitutions, and alterations can be made herein without departing from the scope of the present invention, even if all of the advantages identified above are not present. For example, the various embodiments shown in the drawings herein illustrate that the present invention may be implemented and embodied in a variety of different ways that still fall within the scope of the present invention. Also, the techniques, designs, elements, and methods described and illustrated in the preferred embodiment as discrete or separate may be combined or integrated with other techniques, designs, elements, or methods without departing from the scope of the present invention. For example, the wheel assembly may be removable or integrated into the sole of the footwear. Although the present invention has been primarily described with only one wheel positioned in the opening of the heel, the present invention certainly contemplates and covers multiple wheels positioned in the opening of the heel. Other examples of changes, substitutions, and alterations are readily ascertainable by one skilled in the art and could be made without departing from the spirit and scope of the present invention.

What is claimed is:

1. An apparatus for use on a surface, the apparatus operable to wear on one's foot to transition from a walking state or a running state to a heel rolling state, and then to a heel braking state, the apparatus comprising:

a footwear having a front, a back, an upper part, and a sole, the sole includes:

a forefoot portion to engage the surface while in the walking state and the running state, the forefoot portion inoperable for rolling, an arch portion, a bottom surface, and a heel portion with an opening formed in the bottom surface of the heel portion of the sole;

an axle having a first segment and a second segment; and at least one wheel rotatably mounted on the axle between the first segment of the axle and the second segment of the axle, the axle frictionally retained at the first segment of the axle and the second segment of axle to prevent rotation of the axle, wherein the at least one wheel rotatably mounted on the axle includes a first portion, a second portion, and is positioned such that the first portion of the wheel resides within the opening formed in the bottom surface of the heel portion of the sole of the footwear and such that the second portion of the wheel resides below the opening formed in the bottom surface of the heel portion of the sole of the footwear and below a lowest point of the bottom surface of the heel portion of the sole of the footwear, wherein the at least one wheel is located only in the heel portion and the at least one wheel is the only wheel on the bottom surface of the sole, and whereby the apparatus is operable to allow one to transition from the walking state or the running state to the heel rolling state where the at least one wheel rotatably mounted on the axle contacts the surface to roll, and then to the heel braking state where a portion of the heel portion of the sole contacts the surface.

2. The apparatus of claim 1, wherein the forefoot portion of the sole of the footwear is flexible to bend with one's foot when in the walking state or the running state.

3. The apparatus of claim 1, wherein the at least one wheel rotatably mounted on the axle is positioned in the opening formed in the bottom surface of the heel portion of the sole such that the first portion of the wheel that resides within the opening is larger than the second portion of the wheel that resides below the opening.

4. The apparatus of claim 1, further comprising:

a first precision bearing; and a second precision bearing, and wherein the at least one wheel rotatably mounted on the axle has a first side with a first recess and a second side with a second recess, and the first precision bearing is positioned in the first recess between the wheel and the axle and the second precision bearing is positioned in the second recess between the wheel and the axle.

5. The apparatus of claim 1, wherein the first precision bearing is positioned using a first ring clip on the axle, and the second precision bearing is positioned using a second ring clip on the axle.

6. The apparatus of claim 1, further comprising:

a heel control plate operable to allow one to gain greater control while in the heel rolling state.

7. The apparatus of claim 1, wherein the wheel has an outer diameter and the second portion of the wheel resides below the lowest point of the bottom surface of the heel portion of the sole of the footwear by an amount equal to or less than half of the outer diameter of the wheel.

8. The apparatus of claim 1, wherein the opening formed in the bottom surface of the heel portion of the sole extends from the bottom surface of the sole to a top of the sole.

9. The apparatus of claim 1, wherein the opening formed in the bottom surface of the heel portion of the sole extends from the bottom surface of the sole to a top of the sole, but does not extend to the top of the sole.

10. The apparatus of claim 1, wherein the opening formed in the bottom surface of the heel portion of the sole is closed on all sides except for the bottom of the sole and a top of the sole.

11. The apparatus of claim 1, wherein the opening formed in the bottom surface of the heel portion of the sole is also formed in the bottom surface of the arch portion of the sole.

12. The apparatus of claim 1, further comprising:

a grind plate positioned under the bottom surface of the arch portion of the sole.

13. The apparatus of claim 1, wherein the at least one wheel rotatably mounted on the axle between the first segment of the axle and the second segment of the axle is the only wheel that resides at the bottom surface of the sole of the footwear.

14. The apparatus of claim 1, wherein the portion of the heel portion of the sole of the footwear that contacts the surface in the heel braking state is positioned adjacent the back of the footwear.

15. The apparatus of claim 1, wherein the portion of the heel portion of the sole of the footwear that contacts the surface in the heel braking state is positioned between the back of the footwear and the opening formed in the bottom surface of the heel portion of the sole.

16. The apparatus of claim 15, wherein the portion of the heel portion of the sole of the footwear that contacts the surface in the heel braking state is made of a wear resistant material.

17. An apparatus for use on a surface, the apparatus operable to wear on one's foot to transition from a walking state or a running state to a heel rolling state, and then to a heel braking state, the apparatus comprising:

a footwear having a front, a back, an upper part, and a sole, the sole includes:

a forefoot portion to engage the surface while in the walking state and the running state, the forefoot portion inoperable for rolling, an arch portion, a bottom surface, and a heel portion with an opening formed in the bottom surface of the heel portion of the sole;

an axle having at least a first engagable segment;

a heel brake disposed adjacent the opening formed in the heel portion of the sole of the footwear; and at least one wheel attached to the axle adjacent the at least first engagable segment, the axle frictionally coupled at the at least first engagable segment of the axle to retain the axle, wherein the at least one wheel attached to the axle includes a first portion, a second portion, and is positioned such that the first portion of the wheel resides within the opening formed in the bottom surface of the heel portion of the sole of the footwear and such that the second portion of the wheel resides below the opening formed in the bottom surface of the heel portion of the sole of the footwear and below a lowest point of the bottom surface of the heel portion of the sole of the footwear, wherein the at least one wheel is located only in the heel portion and the at least one wheel is the only wheel on the bottom surface of the sole, and whereby the apparatus is operable to allow one to transition from the walking state or the running state to the heel rolling state where the at least one wheel attached to the axle contacts the surface and rolls, and then to the heel braking state where the heel brake of the apparatus contacts the surface.

18. The apparatus of claim 17, wherein the wheel has an outer diameter and the second portion of the wheel resides below the lowest point of the bottom surface of the heel portion of the sole of the footwear by an amount equal to or less than half of the outer diameter of the wheel.

19. The apparatus of claim 17, wherein the at least one wheel rotatably mounted on the axle is positioned in the opening formed in the bottom surface of the heel portion of the sole such that the first portion of the wheel that resides within the opening is larger than the second portion of the wheel that resides below the opening.

* * * * *

UNITED STATES PATENT AND TRADEMARK OFFICE

CERTIFICATE OF CORRECTION

PATENT NO. : 6,450,509 B2
APPLICATION NO. : 09/540125
DATED : September 17, 2002
INVENTOR(S) : Roger R. Adams It is certified that error appears in the above-identified patent and that said Letters Patent is hereby corrected as shown below:

Title page – page 1
Item [56], References Cited, OTHER PUBLICATIONS
Replace "Sweet Flyers" with --Street Flyers--

Page 2
Item [56], References Cited, U.S. PATENT DOCUMENTS
In the second column of the References Cited, U.S. Patent Documents:
Replace "5,927,737" with --5,927,734--

Drawings
The sheet of drawing consisting of figure 1 should be added as shown on the attached sheet.

Column 7, Line 65
Replace "showm" with --shown--

Signed and Sealed this

Second Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 6,450,509 B2
APPLICATION NO. : 09/540125
DATED : September 17, 2002
INVENTOR(S) : Roger R. Adams It is certified that error appears in the above-identified patent and that said Letters Patent is hereby corrected as shown below:

Title page – page 1
Item [56], References Cited, OTHER PUBLICATIONS
Replace "Sweet Flyers" with --Street Flyers--

Page 2
Item [56], References Cited, U.S. PATENT DOCUMENTS
In the second column of the References Cited, U.S. Patent Documents:
Replace "5,927,737" with --5,927,734--

Drawings
Delete Drawing Sheet 1 of 10 consisting of FIGS 2A and 2B and substitute the attached Drawing Sheet 1 of 10 consisting of FIG. 1
Insert Drawing Sheet 2 of 10 consisting of FIGS: 2A and 2B Column 7, Line 65
Replace "showm" with --shown--

This certificate supersedes Certificate of Correction issued October 2, 2007.

Signed and Sealed this

Twenty-seventh Day of November, 2007

JON W. DUDAS
*Director of the United States Patent and Trademark Office*